US012449228B1

(12) United States Patent
Maschin et al.

(10) Patent No.: US 12,449,228 B1
(45) Date of Patent: Oct. 21, 2025

(54) PNEUMATIC LAUNCHING APPARATUS EMPLOYING PISTON AND CYLINDER CAM DRIVING PATHWAYS AND METHODS

(71) Applicant: Hasbro, Inc., Pawtucket, RI (US)

(72) Inventors: Robert C Maschin, Johnston, RI (US); Nicholas Alexander Tino, Seekonk, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 18/769,605

(22) Filed: Jul. 11, 2024

Related U.S. Application Data

(60) Provisional application No. 63/513,383, filed on Jul. 13, 2023.

(51) Int. Cl.
*F41B 11/641* (2013.01)
*F41B 11/52* (2013.01)
*F41B 11/73* (2013.01)

(52) U.S. Cl.
CPC ..... *F41B 11/641* (2013.01); *F41B 11/52* (2013.01); *F41B 11/73* (2013.01)

(58) Field of Classification Search
CPC ..... F41B 11/64; F41B 11/642; F41B 11/643; F41B 11/644; F41B 11/645; F41B 11/73; F41B 11/52; F41B 11/641
USPC ..... 124/71
See application file for complete search history.

(56) References Cited

U.S. PATENT DOCUMENTS

| | | | | |
|---|---|---|---|---|
| 46,617 | A | 3/1865 | Allen | |
| 159,609 | A | 2/1875 | Prescott | |
| 956,760 | A | 5/1910 | Moulin | |
| 1,441,975 | A | 1/1923 | Edelin | |
| 1,488,995 | A | 4/1924 | McCollom | |
| 1,743,576 | A | 1/1930 | Smith | |
| 1,873,677 | A | 8/1932 | Traver | |
| 2,214,224 | A | 9/1940 | Douglas | |
| 2,450,029 | A * | 9/1948 | Wells | F41B 11/683 92/240 |
| 2,483,752 | A | 10/1949 | Buhl | |
| 2,634,717 | A | 4/1953 | Junkin | |
| 2,725,868 | A | 12/1955 | Foster | |
| 2,737,942 | A | 3/1956 | Horowitz et al. | |
| 3,054,536 | A | 9/1962 | Sagarin | |
| 3,262,440 | A | 7/1966 | Kuhn | |
| 3,385,279 | A | 5/1968 | Pitcher | |
| 3,420,133 | A | 1/1969 | Proll | |
| 3,584,614 | A | 6/1971 | Horvath | |
| 3,847,132 | A | 11/1974 | Schatz | |
| 3,990,426 | A | 11/1976 | Stokes | |

(Continued)

*Primary Examiner* — John Cooper
(74) *Attorney, Agent, or Firm* — Perry Hoffman

(57) ABSTRACT

Launcher apparatus and methods of a toy projectile blaster piston air compression element and breech bolt having a connected cylinder driving arm, and a piston driving arm at the piston. A cylinder cam pathway track and a piston cam pathway track at a firing mechanism positions a piston cam follower linkage tracking end at the piston cam pathway track, and a cylinder cam follower linkage tracking end at the cylinder cam pathway track pivoted at a conveyor of an integral a trigger assembly. A cylinder follower projection is brought into contact with the cylinder driving arm and a piston cam follower projection is brought into contact with the piston driving arm, for fluid communication to outwardly launch the received projectile rounds.

20 Claims, 30 Drawing Sheets

(56) References Cited

U.S. PATENT DOCUMENTS

| | | | | |
|---|---|---|---|---|
| 4,094,294 | A | 6/1978 | Speer | |
| 4,345,578 | A | 8/1982 | Speer | |
| 4,597,527 | A | 7/1986 | Sands | |
| 4,774,929 | A | 10/1988 | Millman | |
| 4,841,945 | A | 6/1989 | Braden | |
| 4,890,404 | A | 1/1990 | Ferri | |
| 5,205,271 | A | 4/1993 | Salva | |
| 5,244,153 | A | 9/1993 | Kuhn et al. | |
| 5,267,549 | A | 12/1993 | Webber | |
| 5,343,850 | A | 9/1994 | Steer | |
| 5,471,967 | A | 12/1995 | Matsuzaki et al. | |
| 5,529,050 | A | 6/1996 | D'Andrade | |
| 5,535,729 | A * | 7/1996 | Griffin | F41B 11/64 124/66 |
| 5,704,150 | A | 1/1998 | Millman | |
| 5,878,734 | A | 3/1999 | Johnson et al. | |
| 6,119,671 | A | 9/2000 | Smith et al. | |
| 6,460,530 | B1 | 10/2002 | Backeris et al. | |
| 6,488,019 | B2 | 12/2002 | Kotsiopoulos | |
| 6,564,788 | B1 * | 5/2003 | Hu | F41B 11/52 124/66 |
| 7,051,727 | B2 | 5/2006 | Wu | |
| 8,082,909 | B2 | 12/2011 | Sopinsky et al. | |
| 8,113,188 | B2 | 2/2012 | Ma | |
| 8,127,753 | B1 | 3/2012 | Brooks et al. | |
| 8,127,754 | B1 | 3/2012 | Johnson et al. | |
| 8,336,531 | B2 | 12/2012 | Fan et al. | |
| 8,371,282 | B2 | 2/2013 | Meggs et al. | |
| 8,397,705 | B2 | 3/2013 | DeHaan et al. | |
| 8,567,378 | B2 | 10/2013 | Nugent | |
| 8,640,683 | B2 | 2/2014 | Meggs et al. | |
| 8,695,579 | B2 | 4/2014 | Huebl | |
| 8,875,688 | B2 | 11/2014 | Nugent | |
| 9,097,476 | B2 | 8/2015 | Mead et al. | |
| 9,097,477 | B1 | 8/2015 | Mead et al. | |
| 9,389,042 | B1 | 7/2016 | Clayton | |
| 9,500,436 | B2 | 11/2016 | Macy | |
| 9,958,230 | B1 | 5/2018 | Nugent et al. | |
| 10,488,143 | B2 | 11/2019 | Victor et al. | |
| 10,488,148 | B2 | 11/2019 | Johnson et al. | |
| 10,823,527 | B2 | 11/2020 | Tino et al. | |
| 10,876,809 | B1 | 12/2020 | Kopman et al. | |
| 10,907,929 | B2 | 2/2021 | Bernal | |
| 2002/0166551 | A1 | 11/2002 | Lee | |
| 2007/0034197 | A1 | 2/2007 | Tschech | |
| 2009/0095272 | A1 | 4/2009 | Zimmerman | |
| 2009/0145412 | A1 | 6/2009 | Barish | |
| 2010/0206281 | A1 | 8/2010 | Kanitz et al. | |
| 2013/0112184 | A1 | 5/2013 | Corsiglia et al. | |
| 2013/0146043 | A1 | 6/2013 | Zarecky et al. | |
| 2013/0312722 | A1 | 11/2013 | Price | |
| 2016/0018184 | A1 | 1/2016 | Park | |
| 2017/0234644 | A1 * | 8/2017 | Cheng | F41B 11/642 124/71 |

* cited by examiner

PNEUMATIC LAUNCHING APPARATUS EMPLOYING PISTON AND CYLINDER CAM DRIVING PATHWAYS AND METHODS

FIELD OF THE INVENTION

The present invention relates generally to launcher apparatus and methods for a toy projectile blaster discharging projectiles such as foam rounds, balls, and flexible projectiles including hydrated super absorbent polymer (SAP) beads, and more particularly, for discharging plural projectile rounds in a novel fashion providing piston and cylinder cam follower timing for driving contact of respective driving arms through piston and cylinder cam followers brought into contact with the piston and cylinder driving arms.

BACKGROUND OF THE INVENTION

Toys are often designed to have play value by simulating a real object, safely and at a reasonable expense. Toy launch apparatus have been marketed as toys for decades and include such devices as water pistols, toy BB rifles, foam projectiles, balls discs, dart blasters and NERF® brand launchers that discharge a soft foam dart. Most air launchers discharging projectiles use a launch spring and a piston and cylinder arrangement to generate the energy and direct that energy to cause the projectile to discharge. The launching apparatus themselves come in various forms, including those simulating rifles, guns, machine gun, shotguns, bows, rocket launchers, grenade launchers and foam car launchers. Generally, from design and function standpoints control of the size and operation of an air chamber in the cylinder is desirable for efficiency and cost considerations.

Projectile launch mechanisms are known in the art and include mechanisms for launching toy darts, balls of various sizes, paint balls, etc. Known projectiles also include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™, stylized toy rifles that launches gel balls or 'gelfire' rounds. In the alternative made of NERF™ brand foam, a solid, spongy cellular material.

The inventions discussed in connection with the described embodiments address these and other deficiencies of the prior art. The features and advantages of the present inventions will be explained in or become apparent from the following summary and description of the preferred embodiments considered together with the accompanying drawings. The projectiles for such launching apparatus include soft foam darts of various designs and sizes, foam balls, also of various sizes, and other soft projectiles.

SUMMARY OF THE INVENTION

In accordance with the present invention, an advantageous method and apparatus are provided in the form of a toy launch apparatus designed to discharge soft projectiles, with an advantageous method and system described with improved piston and cylinder cam follower timing for driving contact of respective driving arms through piston and cylinder cam followers brought into contact with the piston and cylinder driving arms.

Briefly summarized, the inventions relate to a toy launching apparatus capable of launching projectile rounds timed and driven from a piston cam follower linkage having a tracking end at the piston cam pathway track, a piston trigger end pivoted at a trigger conveyor, and a piston follower coupling for engaging the piston driving coupling. A cylinder cam follower linkage has a tracking end at the cylinder cam pathway track, a cylinder trigger end pivoted at the conveyor, and a cylinder follower coupling for engaging the cylinder driving coupling. A pre-firing area defines a breech and an alignment passage at the firing mechanism housing including at least one barrel seal aligned with the projectile launching barrel, the breech being capable of receiving one or more projectiles with a breech bolt of the air compression element capable of extending into the pre-firing area to position a received projectile between the end of the breech bolt and the barrel seal, for fluid communication to outwardly launch the received projectile rounds.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
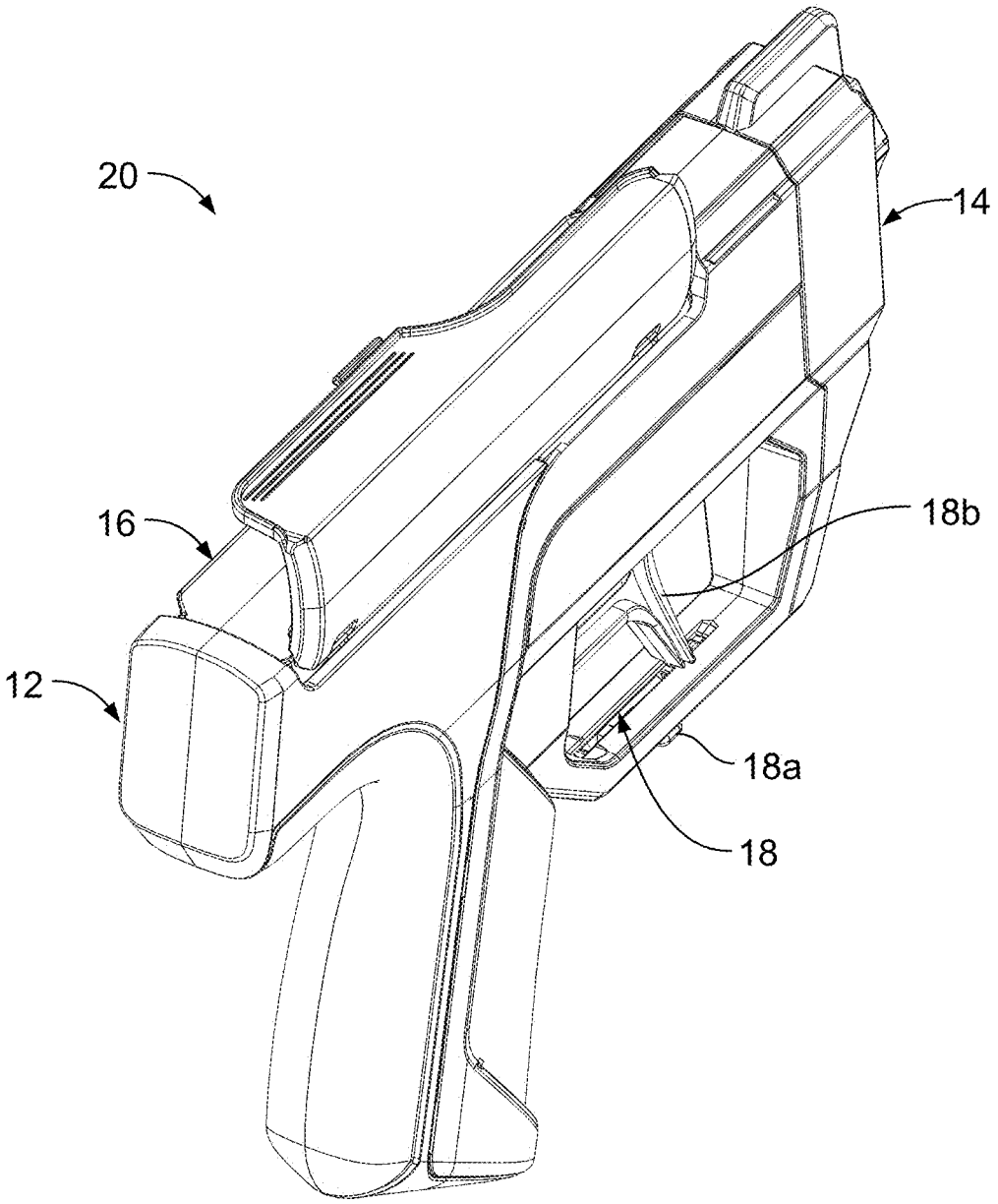
FIG. 1 is an isometric view of an assembled pneumatic launching toy projectile blaster embodiment employing top magazine hopper for rounds with triggering mechanisms in accordance with the present invention in the form of a blaster.
Figure 2A:
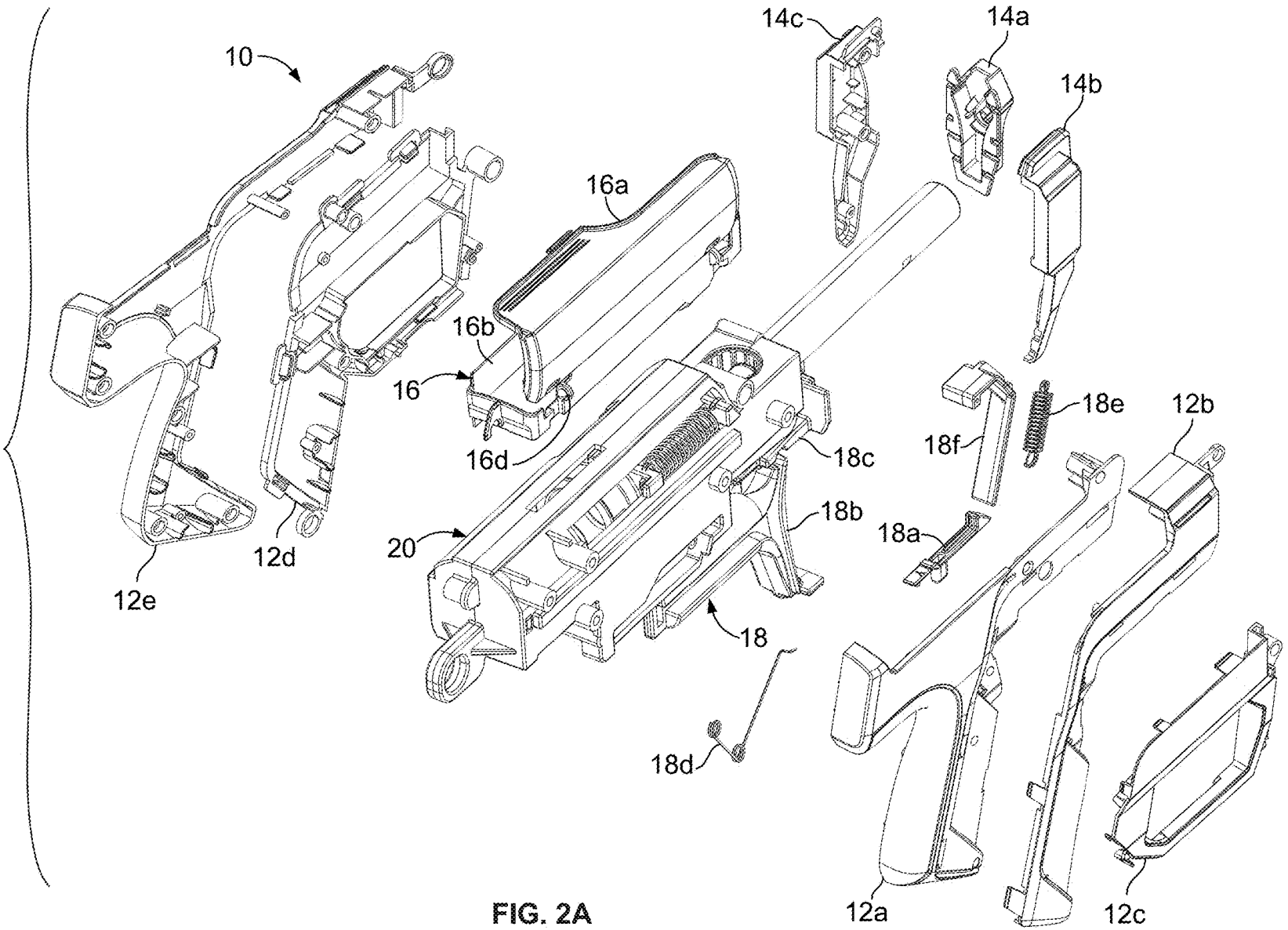
FIG. 2A is an exploded view of the blaster embodiment with an internal firing mechanism subassembly with FIGS. 2B, 2C, 3C, 4C, 5C, 6C, 7C showing exploded views of the firing mechanism enabling toy projectile rounds to enter the pre-firing area, with pneumatic launching functions performed by an air compression element and piston.

FIG. 1 is an isometric view of an assembled blaster 10 pneumatic launching toy with a structural side housing 12 and structural muzzle housing 14. On the top there is a magazine or hopper 16 embodiment employing a gravity fed top hopper for rounds with triggering mechanisms. The trigger assembly 18 has two linkages that the user interacts with a cam follower linkages conveyor 18*c* of trigger 18*b* which is used to fire gel rounds with a functional lock switch 18*a* that activates to prevent the trigger from retracting. FIG. 2A shows an exploded view of the blaster 10 with an internal firing mechanism 20 subassembly. The firing mechanism subassembly 20 is not exploded in FIG. 2A. FIGS. 2B, 2C, 3C, 4C, 5C, 6C, 7C show exploded views of the firing mechanism 20 enabling toy projectile rounds 40 to enter the pre-firing area 20*e*, with pneumatic launching functions performed by an air compression element 20*s* with a cylinder 20*h* and piston 20*k*. The side housing includes the right proximal housing 12*a*, right middle housing 12*b*, right grip housing 12*c*, left grip housing 12*d* and left proximal housing 12*e*. The muzzle housing 14 includes the middle muzzle housing 14*a*, right muzzle housing 14*b* and left muzzle housing 14*c*.

The hopper 16 has a hopper lid 16*a*, and two internal areas: magazine back tray 16*b* and magazine front hopper 16*c* (not shown in FIG. 2A). These internal areas hold gel rounds and are separated by magazine separator 16*d*. The function of the different trays are described in more detail in FIGS. 8A, 8B, 8C. Trigger 18 contains a lock switch 18*a*, a trigger 18*b* and a conveyor 18*c*. Trigger 18*b* and conveyor 18*c* are part of the same integral component and are constrained to move in the longitudinal axis. Conveyor 18*c* attaches to the cylinder cam follower linkage 22 and piston cam follower linkage 26. Trigger lock linkage 18*f* latches onto the conveyor 18*c* when the lock switch 18*a* is activated and the trigger 18*b* is fully advanced. Trigger lock spring 18*e* is a spring that applies a biasing force on trigger lock linkage 18*f*. Returning trigger 18*d* is a torsion spring that applies a biasing force on the trigger 18*b*. Finally, firing mechanism 20 controls the firing of the gel round.

Figure 2B:
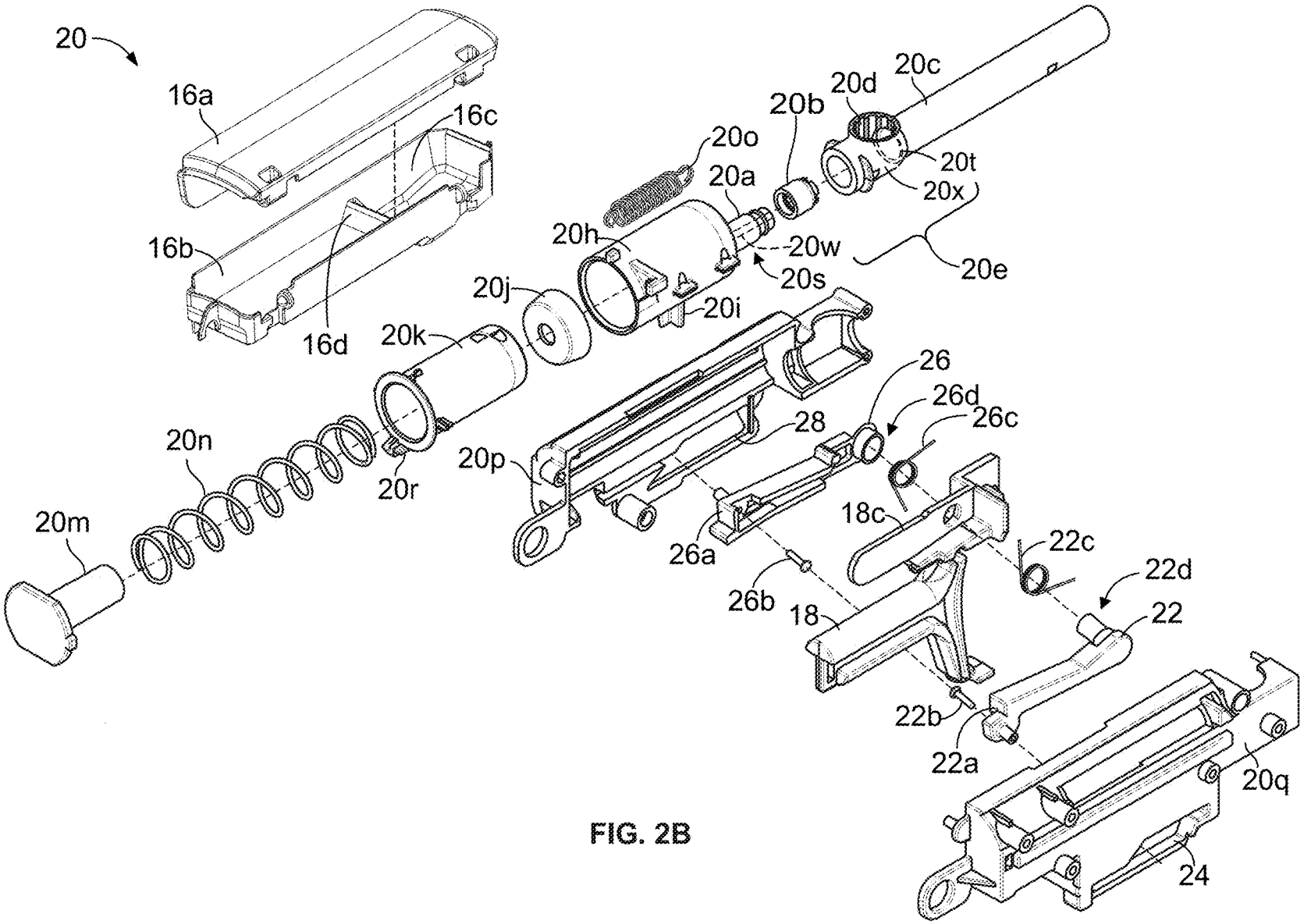
Figure 2C:
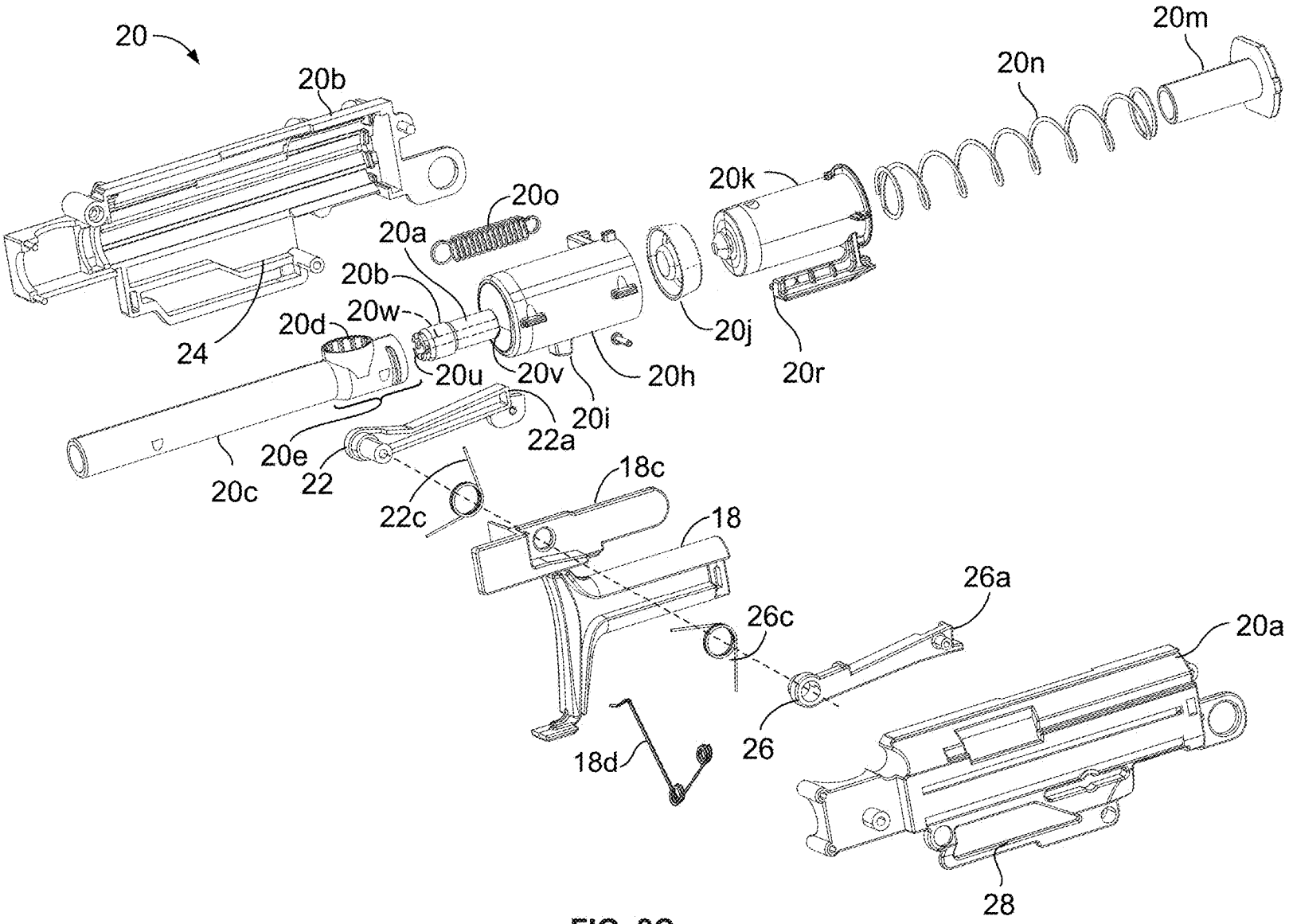

FIGS. 2B and 2C show an exploded view of the firing mechanism 20. The firing mechanism is responsible for enabling a gel round to enter the pre-firing 20*e* area, sealing a gel round in the pre-firing 20*e* area and firing the gel round. These functions are performed by the air compression element 20*s* and piston 20*k*. The air compression element 20*s* and piston 20*k* are constrained to move along the longitudinal axis by the firing mechanism housing. Both the air compression element 20*s* and piston 20*k* each have a cam follower linkage which controls their movement along the longitudinal axis. The air compression element 20*s* is responsible for opening and closing the entryway to the breech 20*d*. The piston 20*k* is responsible for firing the gel round. The firing mechanism is contained within the left firing mechanism housing 20*p* and the right firing mechanism housing 20*q*. Pre-firing area 20*e* holds the gel round prior to being fired. The pre-firing area 20*e* includes the breech 20*d* and the alignment passage 20*x*. The gel round enters the alignment passage 20*x* through the breech 20*d*. When the gel round is fired, the gel round is propelled into the projectile launching barrel 20*c* through the barrel seal 20*t*.

The air compression element 20*s* includes the breech bolt 20*a* and the cylinder 20*h*. When the air compression element 20*s* is in the advanced position, the breech bolt 20*a* extends into the pre-firing area 20*e*. The extension of the breech bolt 20*a* into the pre-firing area 20*e* blocks the breech 20*d*. Blocking the breech 20*d* prevents the gel round from exiting the pre-firing area 20*e* through the breech 20*d* and prevents additional gel rounds from entering the pre-firing area 20*e*. The breech bolt 20*a* has a distal end 20*u* and a proximal end 20*v*. The proximal end 20*v* is at the cylinder 20*h*. The breech bolt seal 20*b* attaches to the breech bolt distal end 20*u*. The gel round is held between the breech bolt seal 20*b* and the barrel seal 20*t* prior to firing. The distal end of the breech bolt 20*u* and the breech bolt seal 20*b* have a channel for fluid communication 20*w* with the alignment passage 20*x*. Since the inside of the cylinder 20*h* has fluid communication with the breech bolt 20*a*, the inside of the cylinder 20*h* has fluid communication with the alignment passage 20*x* through the fluid communication channel 20*w*. Air compression element 20*s* slidably receives the piston 20*k*.

The piston compresses the air within the air compression element 20*s* by rapidly sliding into the cylinder 20*h*. Since the inside of cylinder 20*h* has fluid communication with the breech bolt, if the cylinder 20*h* rapidly receives the piston 20*k* air will be rapidly expelled through the fluid communication channel 20*w* and the gel round will be pneumatically launched through the barrel 20*c*. The piston seal 20*j* attaches to the distal end of the piston 20*k*. The piston seal 20*j* reduces the friction when the cylinder 20*h* slidably receives the piston 20*k*. The outside of the piston 20*k* does not contact the inside of the cylinder 20*h*. Instead, the piston seal 20*j* contacts the inside of the cylinder 20*h*. The piston seal 20*j* reduces friction because it is lubricated. Piston seal 20*j* contacts the inside of the cylinder 20*h* to increase the air pressure inside the air compression element 20*s* during firing. Likewise, the outside of the breech bolt 20*a* does not contact the inside of the alignment passage 20*x*. Instead, the barrel seal 20*b* contacts the inside of the alignment passage 20*x*. The breech bolt seal 20*b* reduces friction because it is lubricated. Barrel seal 20*b* contacts the inside of the alignment passage 20*x* so that air that flows through the fluid communication channel 20*w* during firing continues through barrel 20*c*.

The firing mechanism controls when the breech bolt 20*a* blocks and unblocks the breech as well as when the piston 20*k* pneumatically firing the gel round. The firing mechanism operates with timing in five (5) cyclic steps which dictate and drive the movement of the air compression element 20*s* and the piston 20*k*. Each step is activated as the trigger is pulled back. First, the air compression element 20*s* and piston 20*k* are fully advanced. The breech bolt 20*a* blocks the breech 20*d*. Second, the air compression element 20*s* and piston 20*k* both retract. The breech bolt 20*a* no longer blocks the breech 20*d* so a gel round can enter the pre-firing area 20*e*. Third, the piston 20*k* retracts while the air compression element 20*s* advances. The breech bolt 20*a* blocks the breech 20*d*. The gel round is sealed within the alignment passage 20*x* and any further gel rounds are prevented from entering the pre-firing area 20*e*. Fourth, the piston 20*k* quickly advances. The air inside the air compression element 20*s* suddenly compresses. Due to the pressure difference between the air in the air compression element 20*s* and the barrel 20*c*, the gel round is pneumatically propelled out of the barrel. Finally, both the air compression element 20*s* and piston 20*k* have fully advanced, hence completing the cycle.

Both the air compression element 20*s* and the piston 20*k* retract with the trigger at first. However, the air compression element 20*s* and piston 20*k* advance when the trigger has retracted enough. The trigger position for which the air compression element 20*s* and piston 20*k* advance are different. This retraction and advancement timing are controlled by two cam follower linkages; one for the air compression element 20*s* and one for the piston 20*k*. A breech bolt spring 200 and piston spring 20*n* attach to the cylinder 20*h* and the piston 20*k* respectively. These springs apply a biasing force on the air compression element 20*s* and piston 20*k*. Additionally, piston spring alignment 20*m* ensures piston spring 20*n* is in line with the piston 20*k*, air compression element 20*s* and barrel 20*c*. Cylinder cam follower linkage 22 and piston cam follower linkage 26 control the positions of the air compression element 20*s* and piston 20*k* respectively. The cam follower linkages control when the air compression element 20*s* and 20*k* retract and advance. The cam follower linkages are pivoted at the conveyor 18*c*. The cylinder cam follower linkage 22 is pivoted at the cylinder trigger end 22*d*. Likewise, the piston cam follower linkage 26 is pivoted at the piston trigger end 26*d*. The cam follower linkages are also constrained in a vertical plane. As such, when the trigger 18*b* retracts the cam follower linkages also retract.

The cam follower linkages may engage with the cylinder 20*h* or piston 20*k* to retract cylinder 20*h* or piston 20*k*. The cylinder cam follower linkage 22 has a cylinder follower coupling 22*a* which may engage with the cylinder driving coupling 20*r*. Likewise, the piston cam follower linkage 26 has a piston follower coupling 26*a* which may engage with the piston driving coupling 20*i*. When the follower couplings are engaged with their respective driving coupling, the follower couplings may apply a force on their respective driving couplings. If the trigger 18*b* is retracting while a follower coupling is engaged, air compression element 20*s* or the piston 20*k* will also retract. The cam follower linkages also track their respective cam pathway track. The cam pathway track may determine the rotation of the cam follower linkages and whether they are engaged with their driving couplings. The cylinder cam follower linkage 22 has a tracking end 22*b* which tracks the cylinder cam pathway track 24. Likewise, the piston cam follower linkage 26 has a tracking end 26*b* which tracts the piston cam pathway track 28. Cylinder biasing spring 22*c* and piston biasing spring 26*c* are torsional springs which apply a biasing force on the cylinder cam follower linkage 22 and piston cam follower linkage 26 respectively to raise and lower these follower linkages for their timing actuations. These biasing springs ensure that the tracking ends track their respective pathways. If the cam follower linkages retract enough, the cam pathway tracks cause the cam follower linkages to rotate and have the follower couplings disengage with their driving couplings. If disengagement occurs, only the biasing forces would be present on the air compression element 20*s* or the piston 20*k*; the air compression element 20*s* and piston 20*k* would quickly advance.

The follower couplings disengage with their driving couplings when the cam follower pathways move the tracking ends low enough. However, the follower couplings engage with their driving couplings when the cam follower pathways allow the tracking to be ends high enough and the follower couplings are in front of the driving couplings. In other words, retracting the cam follower linkages far enough will disengage the follower couplings from the driving couplings, but advancing the cam follower linkages far enough will not engage the follower couplings with the driving couplings until the follower couplings are in front of the driving couplings.

The difference between the air compression element 20*s* and piston 20*k* mechanisms is the time at which the follower couplings disengage with the driving couplings. The piston driving coupling 20*i* becomes unengaged when the trigger 18*b* retracts farther than where the cylinder driving coupling 20*r* becomes unengaged. In other words, the piston 20*k* becomes unengaged, and hence advances, at a later step than the air compression element 20*s*. The magazine lid 16*a*, back tray 16*b*, front tray 16*c* and the magazine separate 16*d* are shown more clearly in FIG. 2B.

Figures starting in 3, 4, 5, 6 and 7 show the blaster during steps 1, 2, 3, 4 and 5 respectively. The figures ending in A show a half-plane view of blaster 10 with the cylinder cam follower linkage mechanism highlighted. The figures ending in B only show the cylinder cam follower linkage 22 and the cylinder cam pathway track 24. The figures ending in F show a half-plane view of the blaster 10 with the piston cam follower linkage mechanism highlighted. The figures ending in G ending in only show the piston cam follower linkage 26 and the cylinder cam pathway track 28.

Figure 3F:
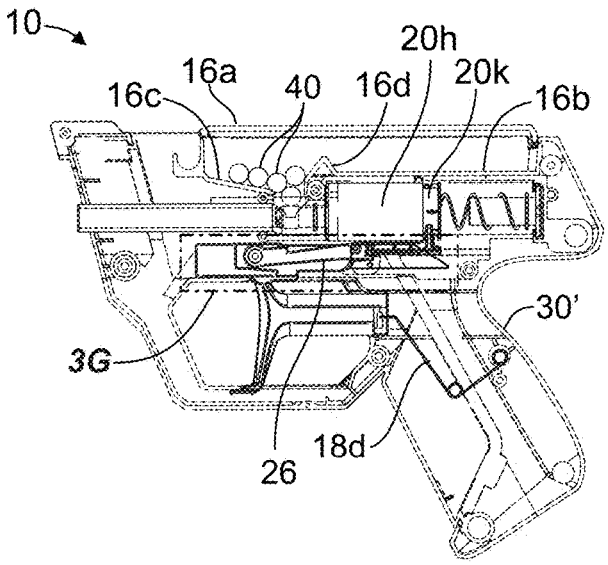
FIGS. 3A, 3A', 3B, 3B' and 3F, 3F', 3G, 3G' show the blaster embodiment in side-elevation firing mechanism sectional and respective cylinder and piston cam pathway tracking/cam follower linkages inset views in an initial trigger at rest first step, where
FIGS. 3C, 3D, and 3E show initial step firing mechanism partial isometric views illustrating the cam pathway tracks/cam follower linkages functionally attached at the conveyor of the blaster trigger.
Figure 3A:
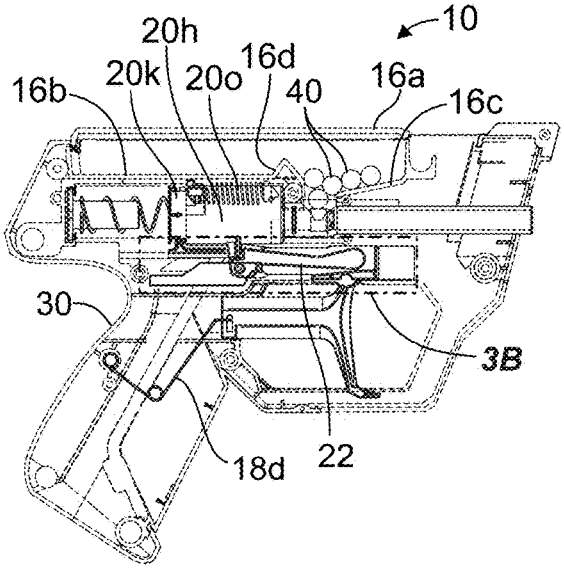
Figure 3G:
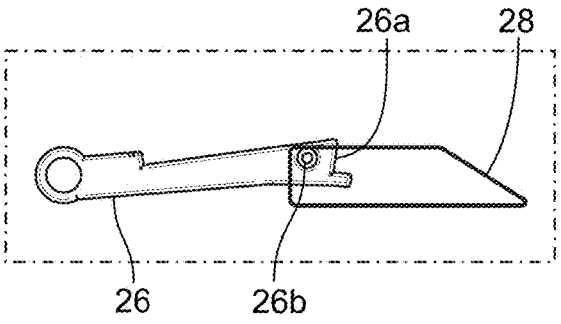
Figure 3B:
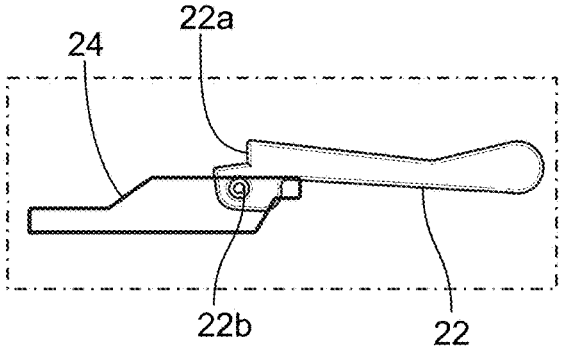
Figure 3A:
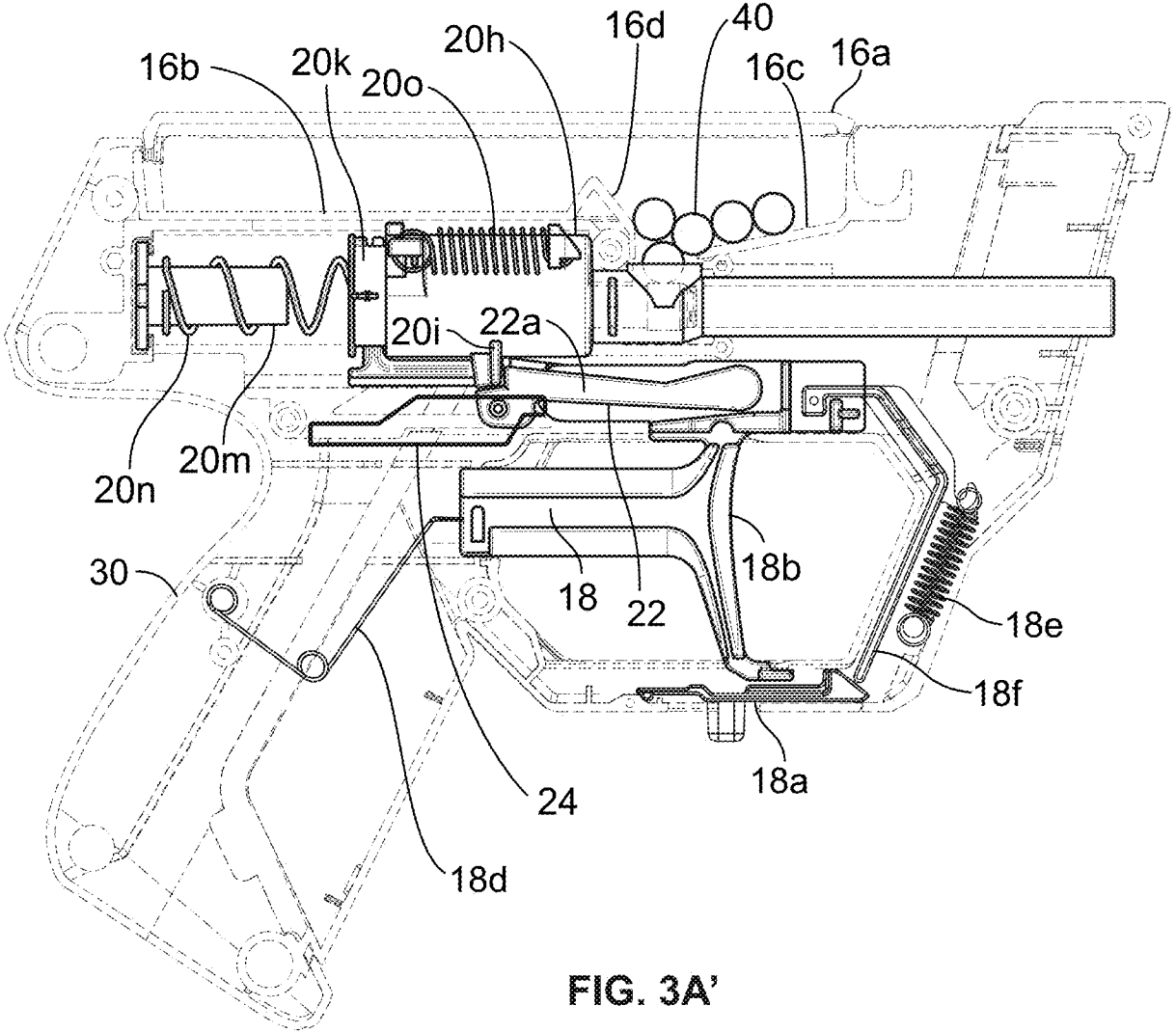
Figure 3C:
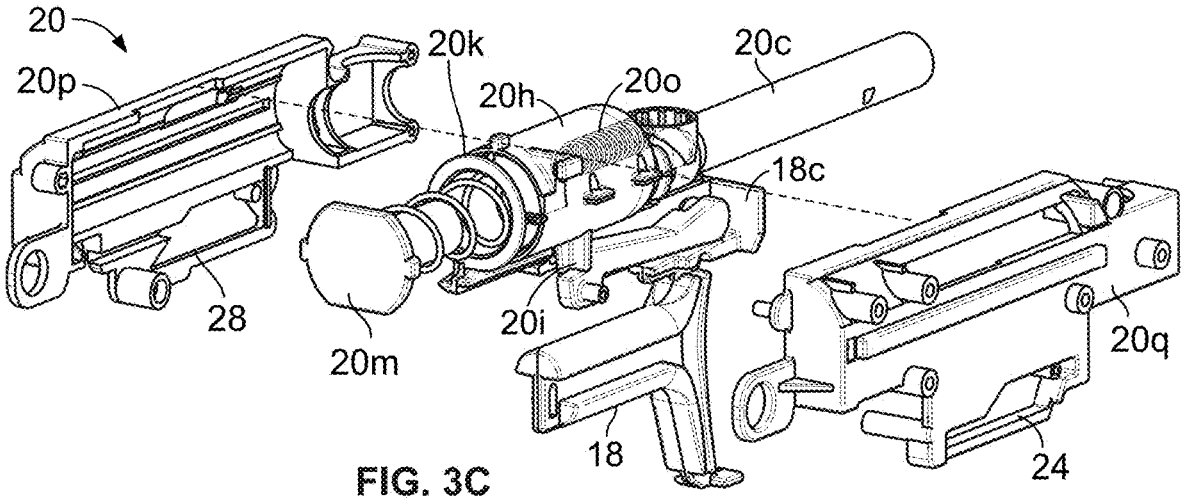
Figure 3B:
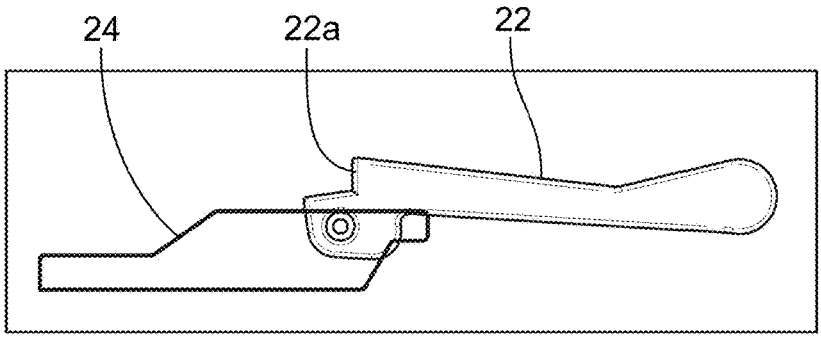
Figure 3D:
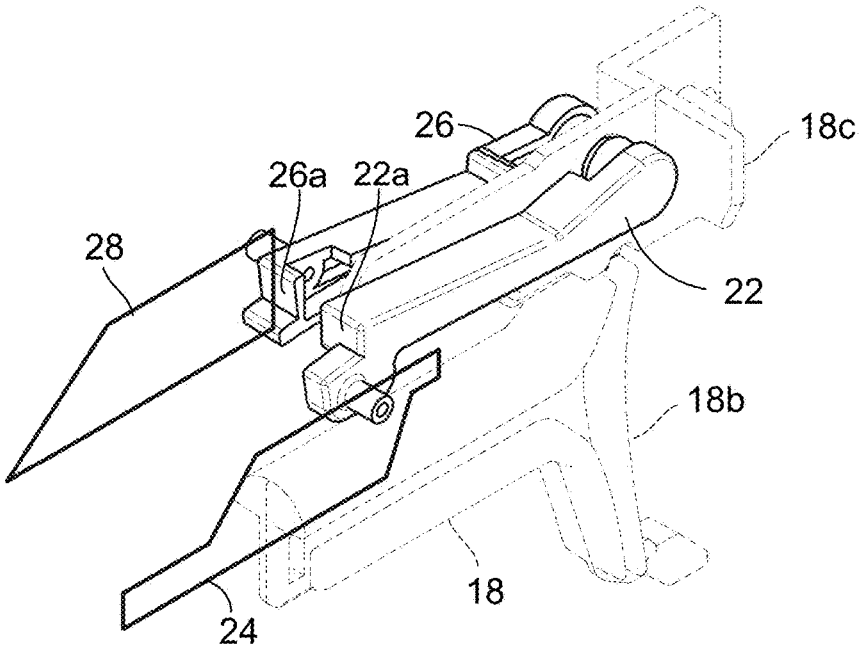
Figure 3E:
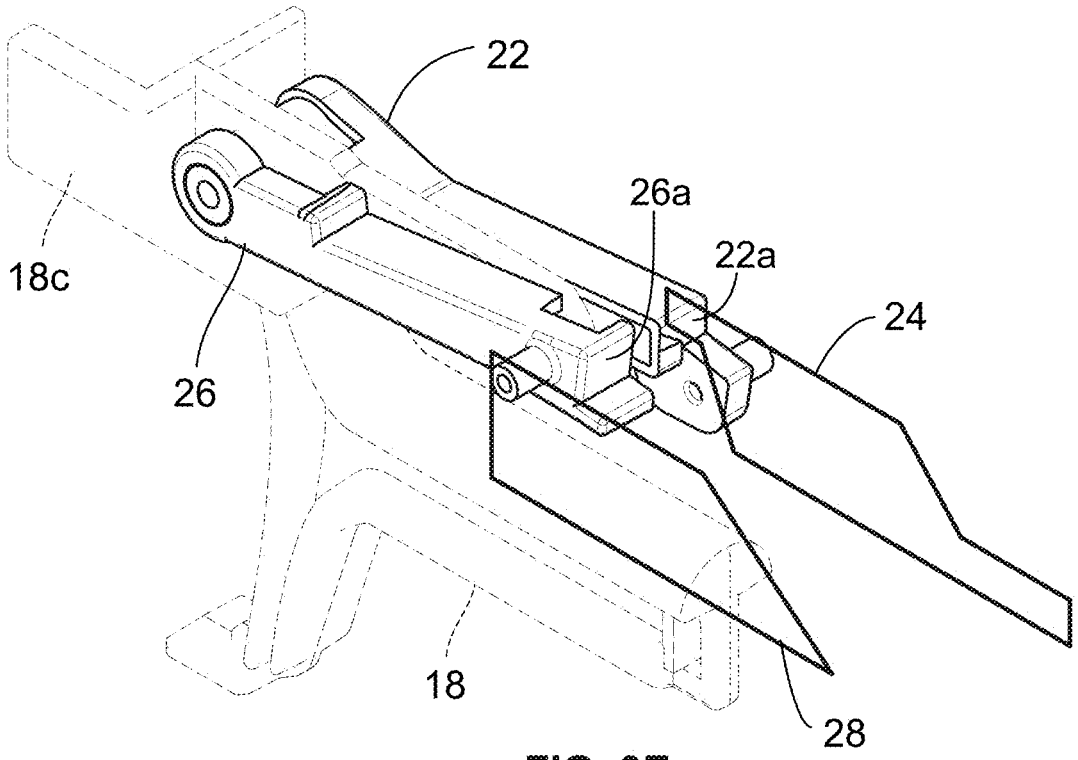
Figure 3G:
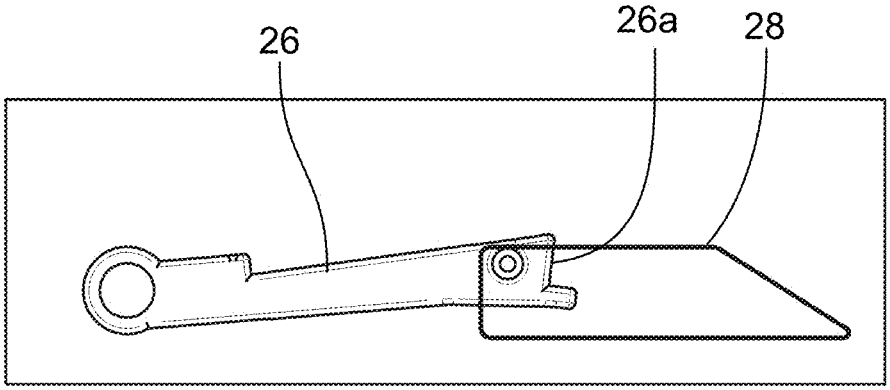
Figure 3F:
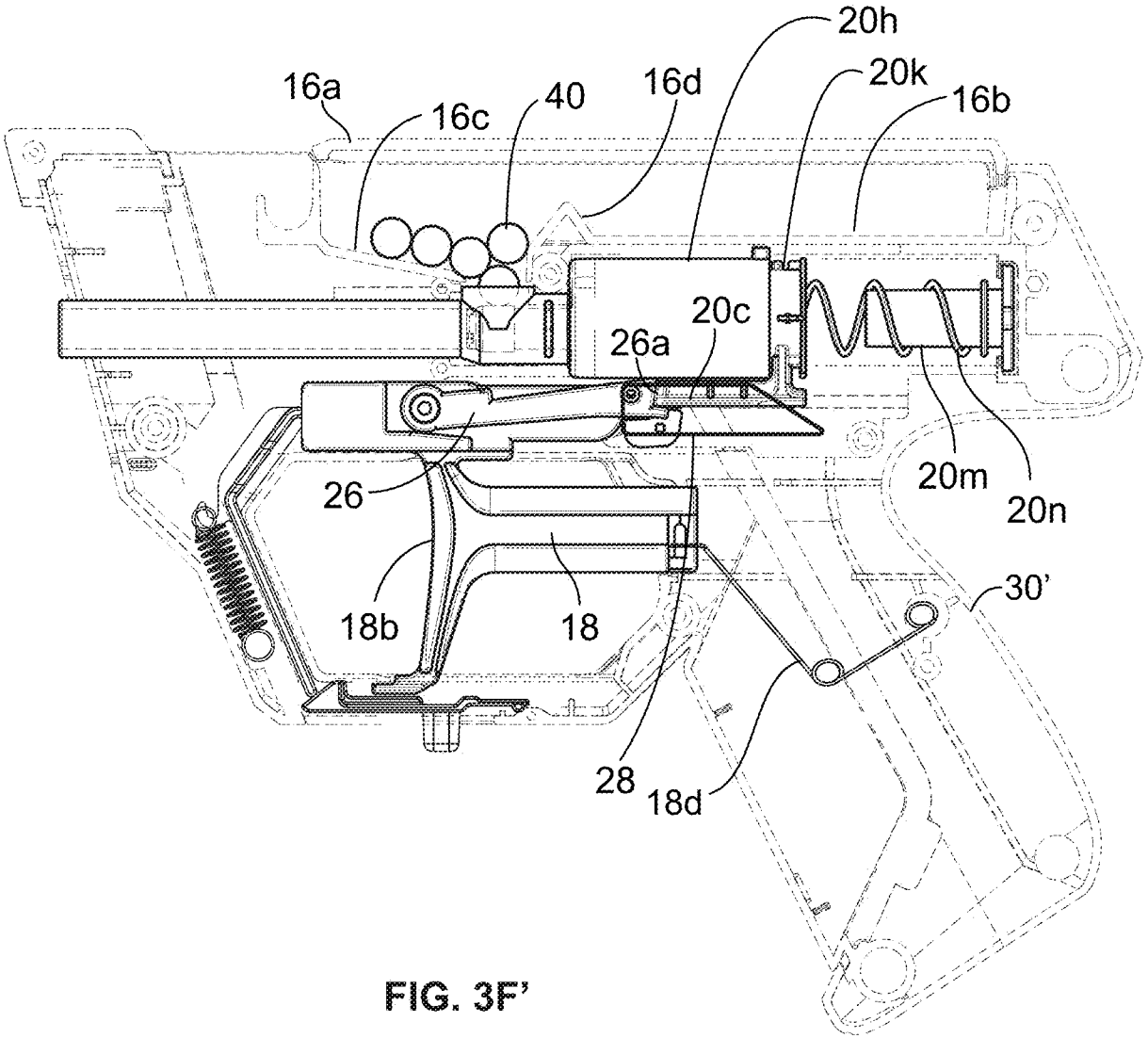

FIGS. 3A and 3F show the blaster 10 in side-elevation sectional views 30, 30' illustrating firing mechanism 20 in an initial trigger at rest first step. Herein the respective cylinder 20*h* and piston 20*k* tracking cam pathway tracks 24, 28 are used for raising and lowering operations of cam follower linkages 22, 26 pivotably provided in enlarged and inset views (see, FIGS. 3A', 3B, 3B', 3F', 3G, 3G'). FIGS. 3C, 3D, and 3E show first step firing mechanism 20 partial isometric views positioning the cam follower linkages 22, 26 at couplings 22*a*, 26*a* driving arms 20*i*, 20*r* coupling to cylinder 20*h* and piston 20*k* corresponding structures through the cam pathway tracks 24, 28 as functionally attached at the conveyor 18*c* of the blaster trigger 18.

FIGS. 3A and 3F show the blaster 10 during the first step, where the breech bolt 20*a* extends into the pre-firing area 20*e*. There are no gel rounds in the barrel 20*c* or the pre-firing area 20*e*. No gel rounds may enter the breech 20*d* as the breech 20*d* is blocked by the breech bolt 20*a*. The trigger 18*b* is fully advanced. Therefore, the cylinder cam follower linkage 22 and the piston cam follower linkage 26 are also fully advanced. The cylinder trigger end 22*d* engages with the cylinder driving coupling 20*r*. Likewise, the piston trigger end 26*d* engages with the piston driving coupling 20*i*. FIG. 3C shows an exploded view of the firing mechanism during the first step. FIGS. 3D and 3E show an isometric view of the cam follower linkages, cam pathway tracks, trigger 18*b* and conveyor 18*c* during the first step. FIG. 3G shows the piston cam follower linkage 26 tracking with the piston cam pathway track 28. FIG. 3B shows the cylinder cam follower linkage 22 tracking with the cylinder cam pathway track 26, and likewise with FIG. 3B' and FIG. 3G'. In both figures, the cam follower linkages have not rotated to disengage with their respective driving couplings.

Figure 4F:
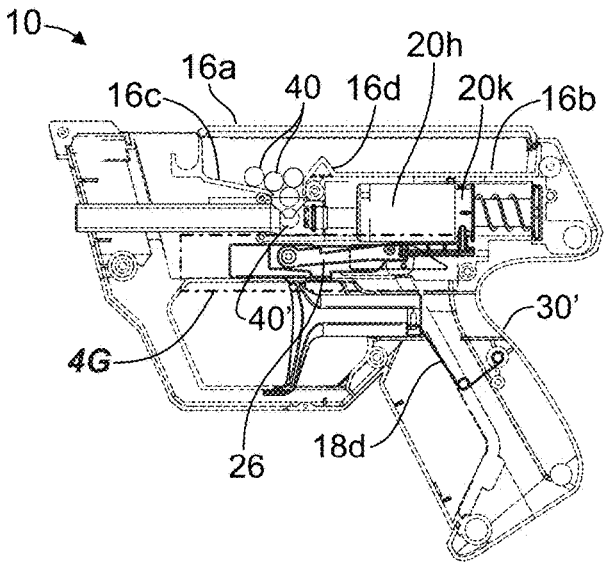
FIGS. 4A, 4A', 4B, 4B' and 4F, 4F', 4G, 4G' show the blaster embodiment in side-elevation firing mechanism sectional and respective cylinder and piston cam pathway tracking/cam follower linkages inset views, along with FIGS. 4C, 4D, and 4E advancing to a loading step of the firing mechanism partial isometric views illustrating the cam pathway tracks/cam follower linkages functionally attached at the conveyor of the blaster trigger.
Figure 4A:
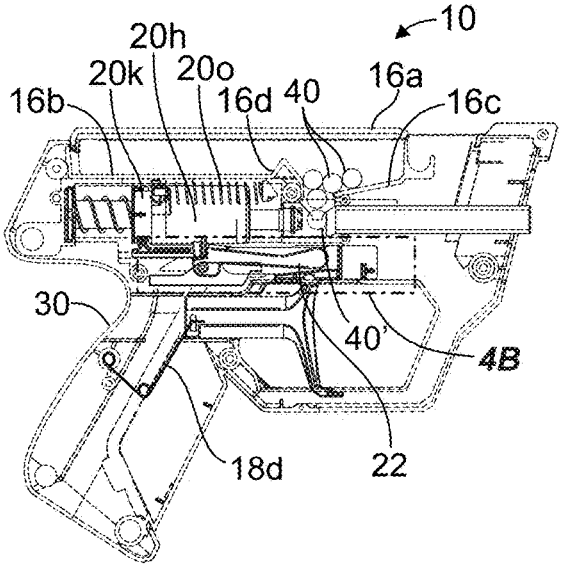
Figure 4G:
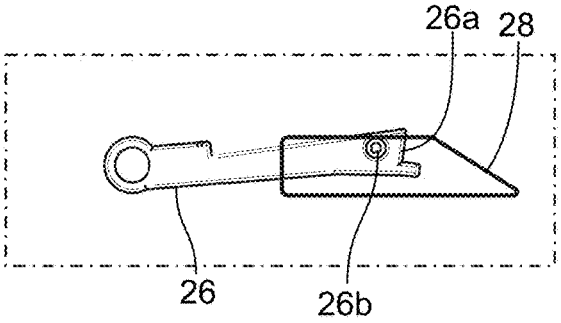
Figure 4B:
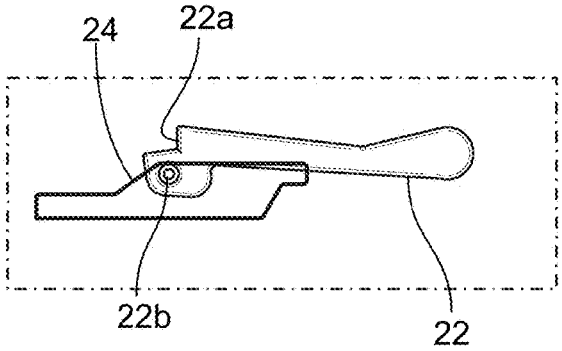
Figure 4A:
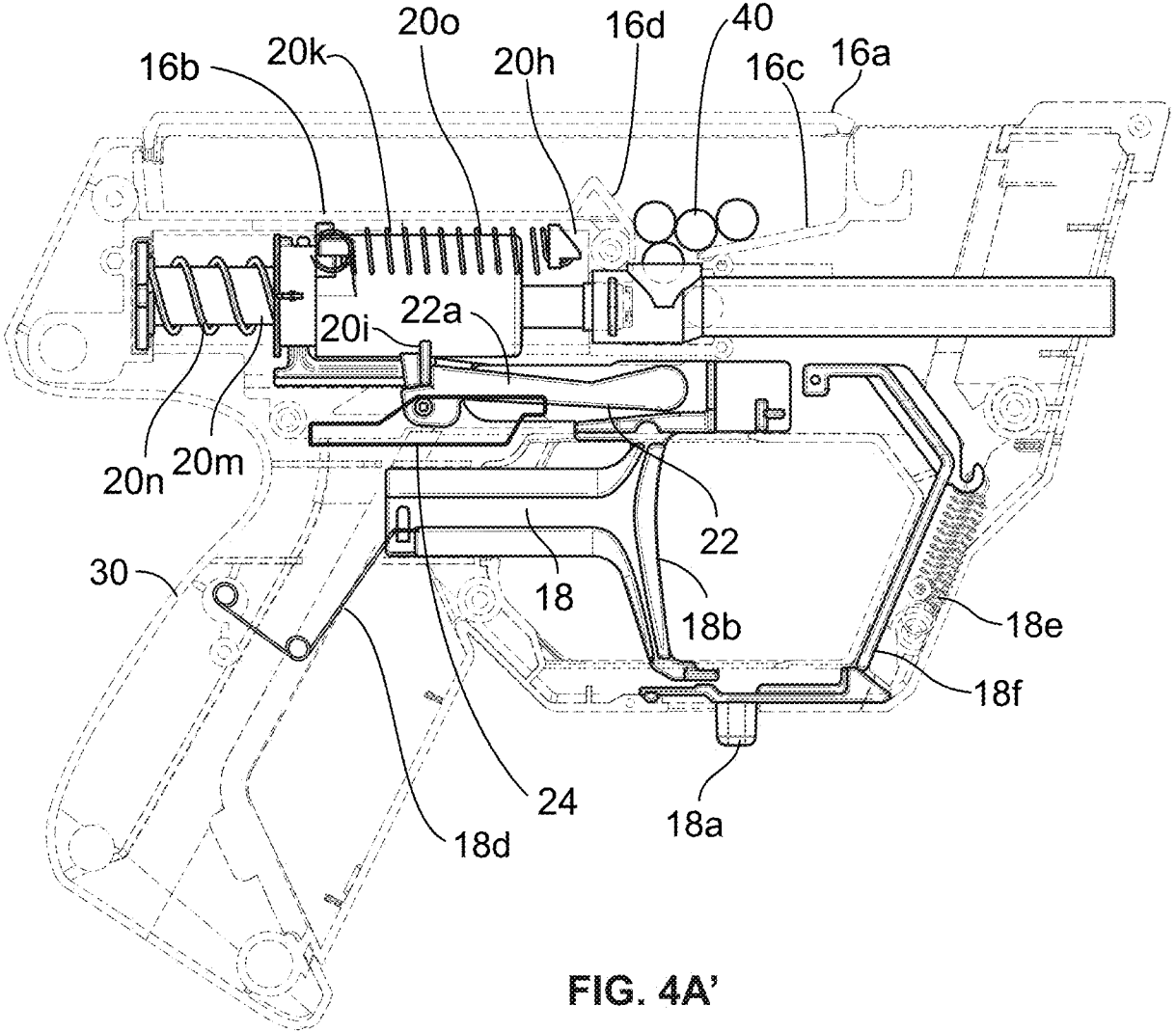
Figure 4C:
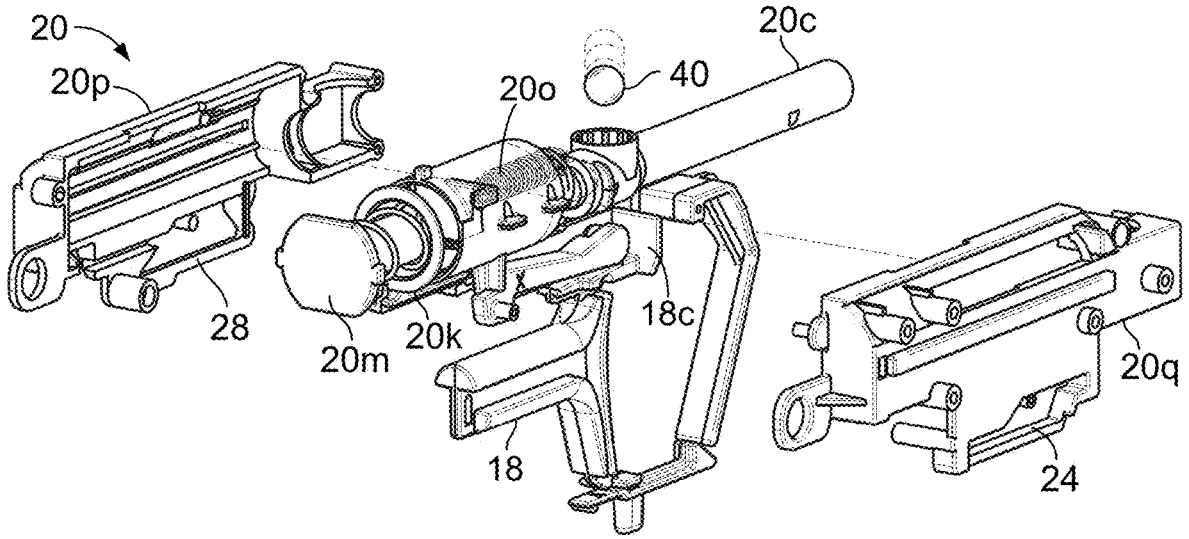
Figure 4B:
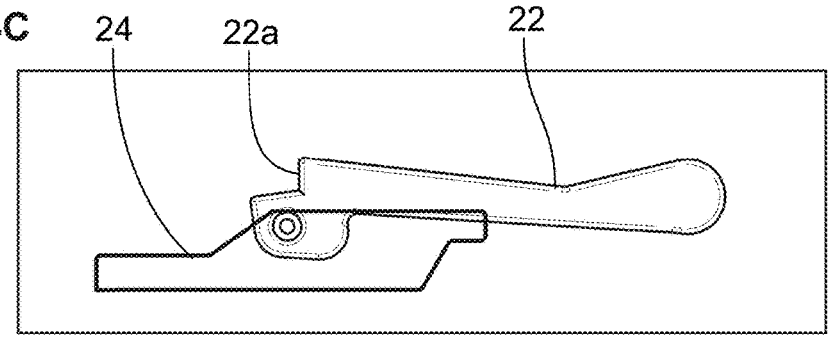
Figure 4D:
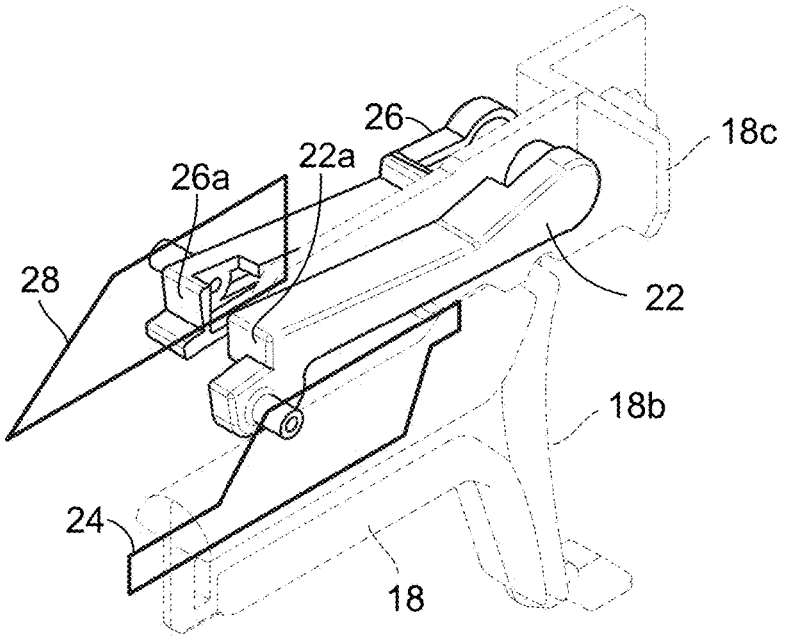
Figure 4E:
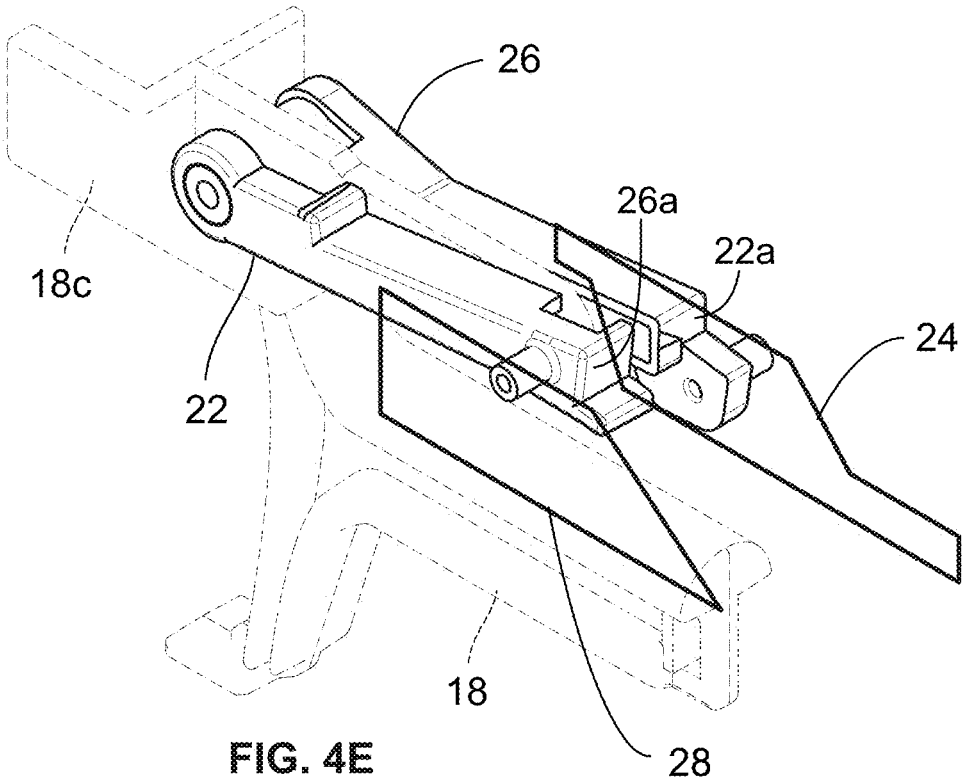
Figure 4G:
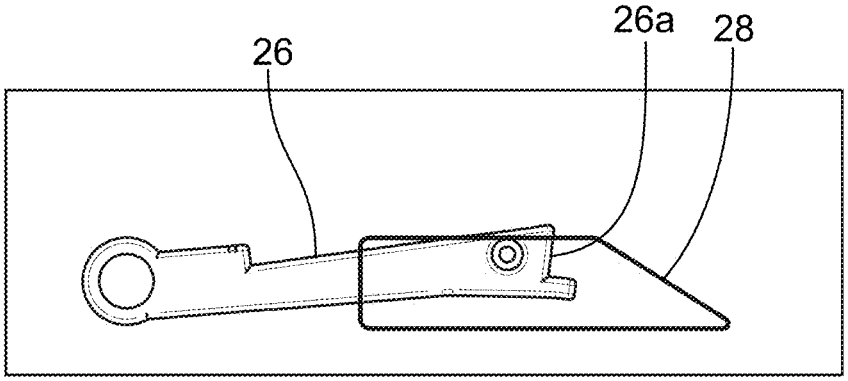
Figure 4F:
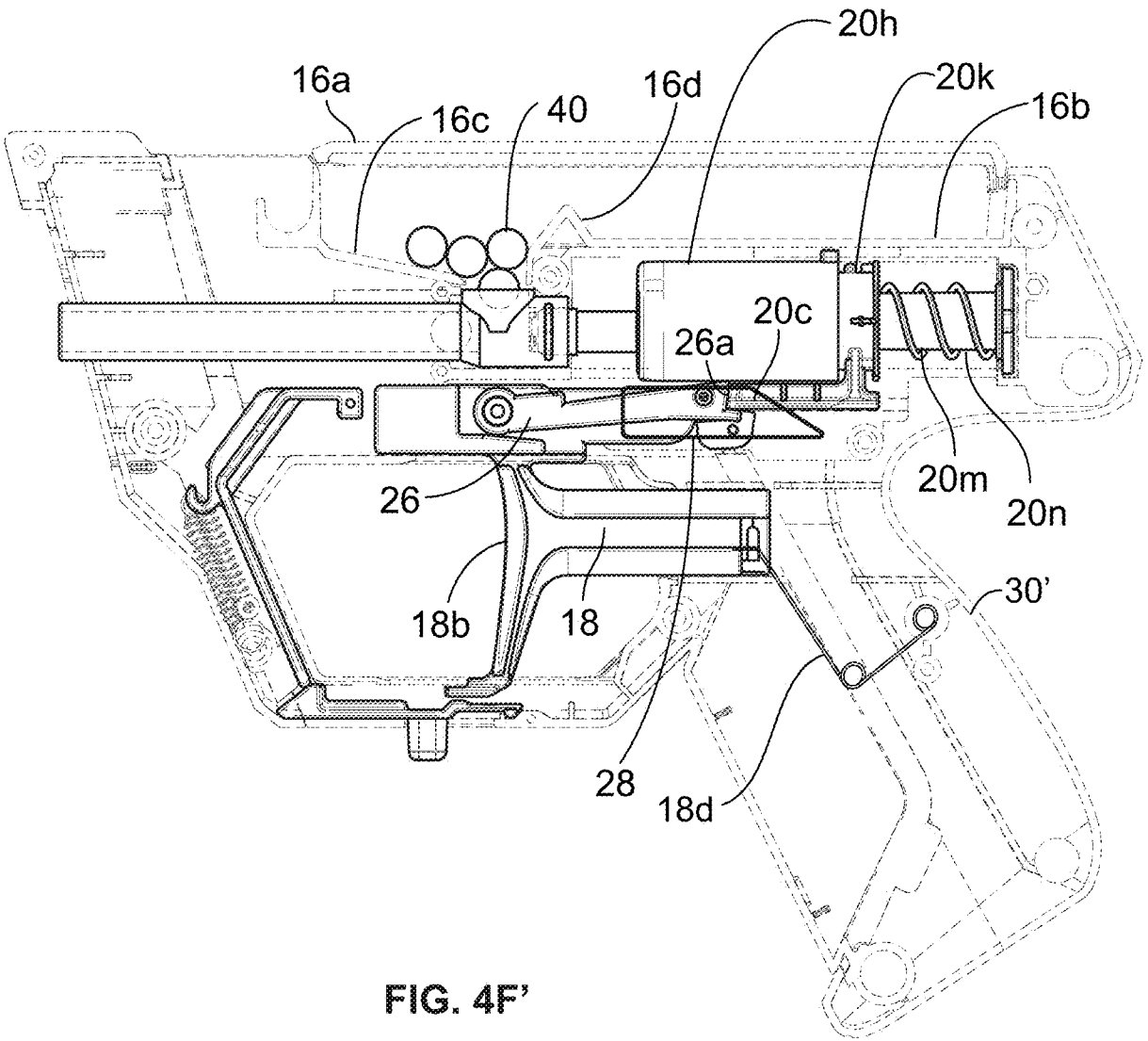

FIGS. 4A and 4F show the blaster 10 in side-elevation sectional views 30, 30' illustrating firing mechanism 20 where initial trigger 18 movement causes the cam follower linkages 22, 26 to start to retract breech bolt 20*a* and load projectile round 40 while starting to extend piston 20*k* at the second step. Herein the respective cylinder 20*h* and piston 20*k* tracking cam pathway tracks 24, 28 are used for raising and lowering operations of cam follower linkages 22, 26 pivotably provided in enlarged and inset views (see, FIGS. 4A', 4B, 4B', 4F', 4G, 4G'). FIGS. 4C, 4D, and 4E show second step firing mechanism 20 partial isometric views positioning the cam follower linkages 22, 26 at couplings 22*a*, 26*a* driving arms 20*i*, 20*r* coupling to cylinder 20*h* and piston 20*k* corresponding structures through the cam pathway tracks 24, 28.

The trigger 18*b* is pulled back which causes the cam follower linkages to also retract. FIGS. 4G and 4B show the cam follower linkages tracking their respective cam pathway tracks. In both figures, the cam follower linkages have not progressed far enough to rotate and disengage with their respective driving couplings. The retraction of the cam follower linkages causes the follower couplings to apply a force on the driving couplings which in turn causes the air compression element 20*s* and the piston 20*k* to retract as well. The breech bolt spring 200 and piston spring 20*n* become compressed. Due to the retraction of the air compression element 20*s*, the breech bolt 20*a* retracts from the pre-firing area 20*e*. Once the breech bolt 20*a* is retracted from the pre-firing area 20*e*, a gel round then enters the pre-firing area 20*e* through the breech 20*d* from the front magazine hopper 16*c* by gravity.

Figure 5F:
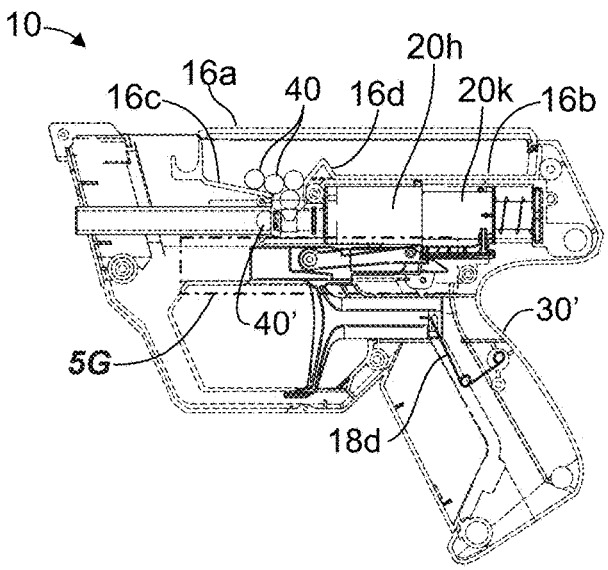
FIGS. 5A, 5A', 5B, 5B' and 5F, 5F', 5G, 5G' show the blaster embodiment in side-elevation firing mechanism sectional and respective cylinder and piston cam pathway tracking/cam follower linkages inset views, along with FIGS. 5C, 5D, and 5E advancing step to further retract piston of firing mechanism partial isometric views illustrating the cam pathway tracks/cam follower linkages functionally attached at the conveyor of the blaster trigger.
Figure 5A:
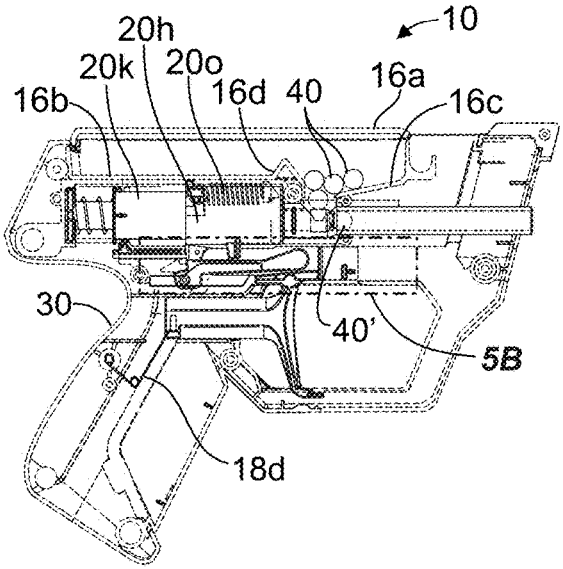
Figure 5G:
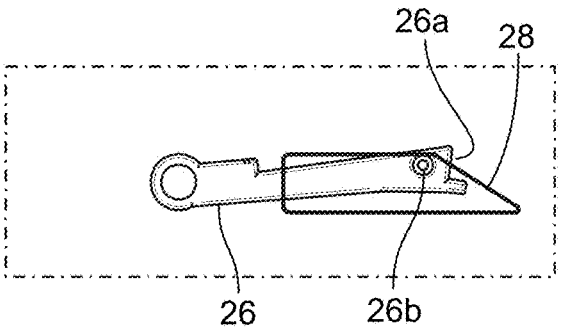
Figure 5B:
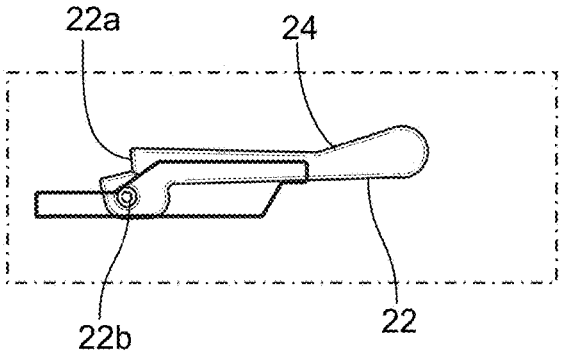
Figure 5A:
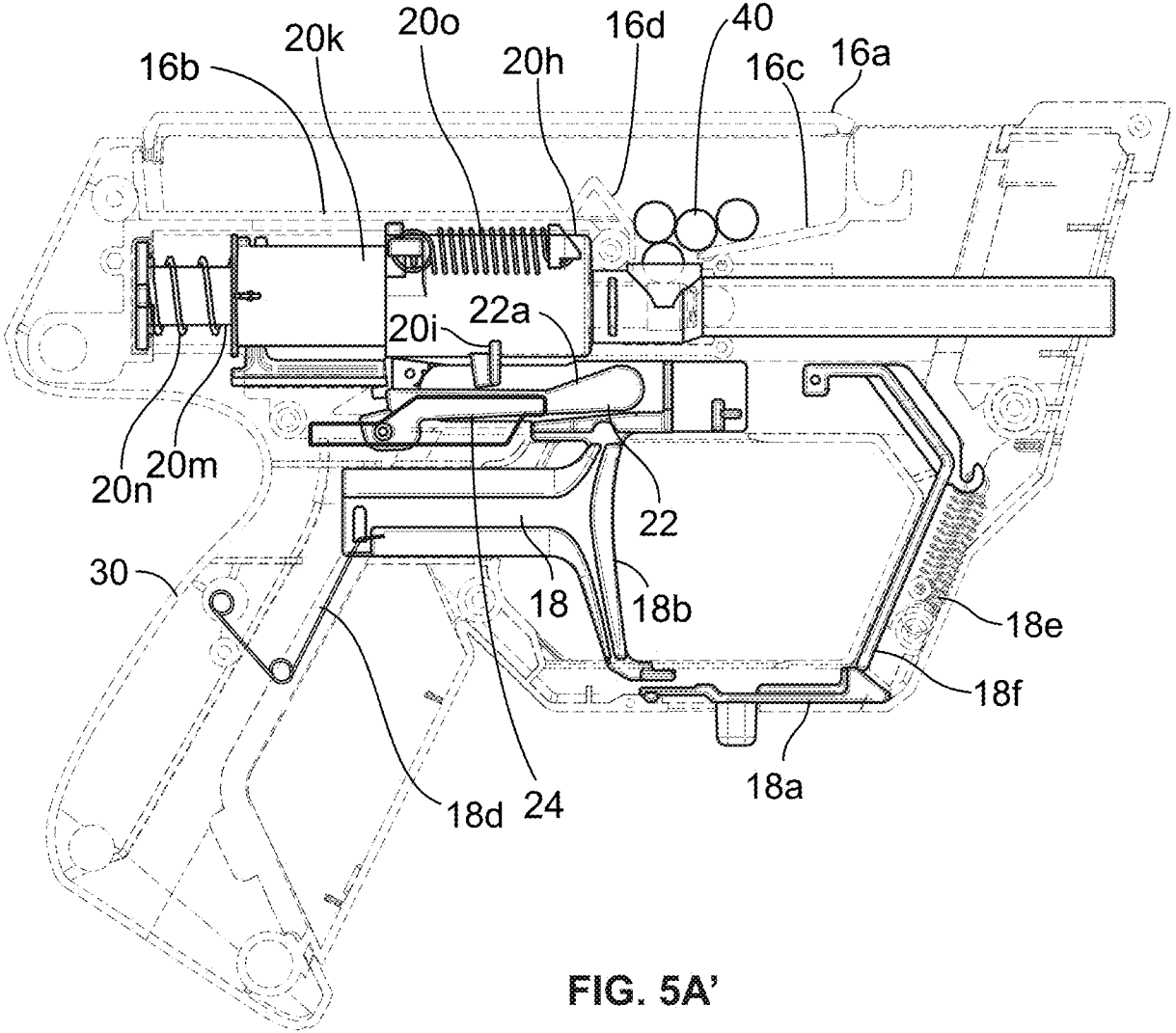
Figure 5C:
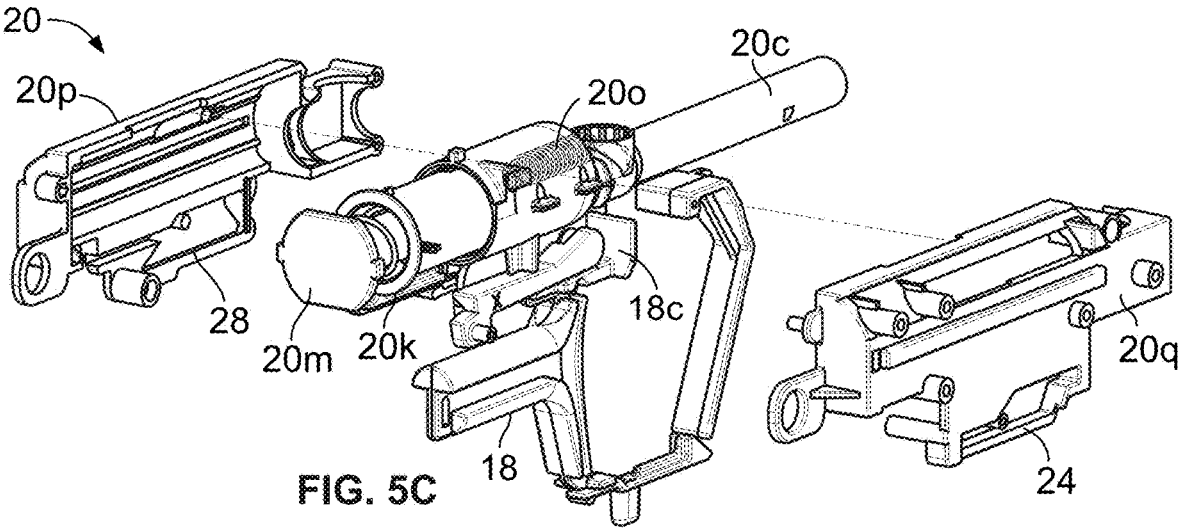
Figure 5B:
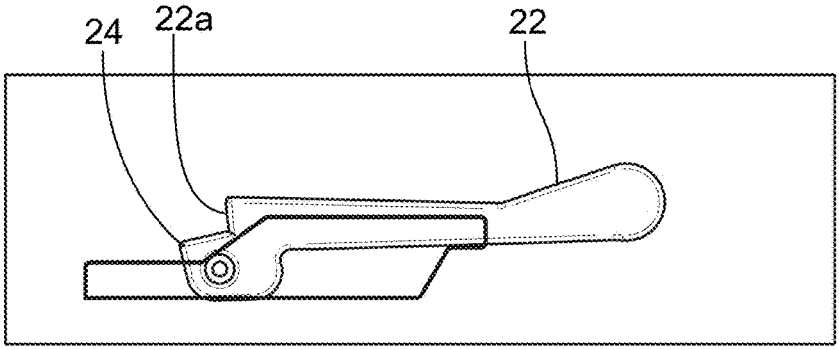
Figure 5D:
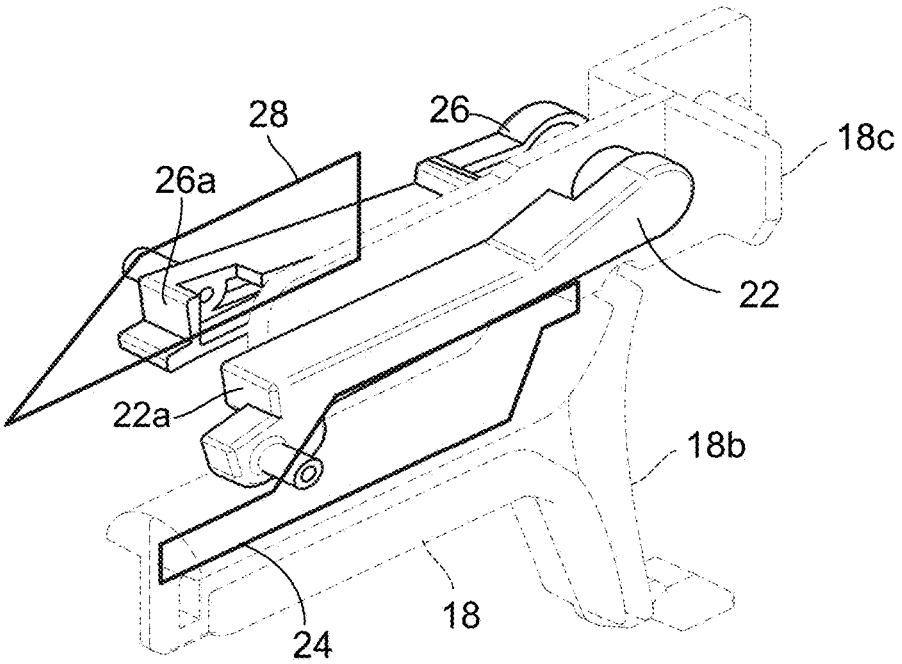
Figure 5E:
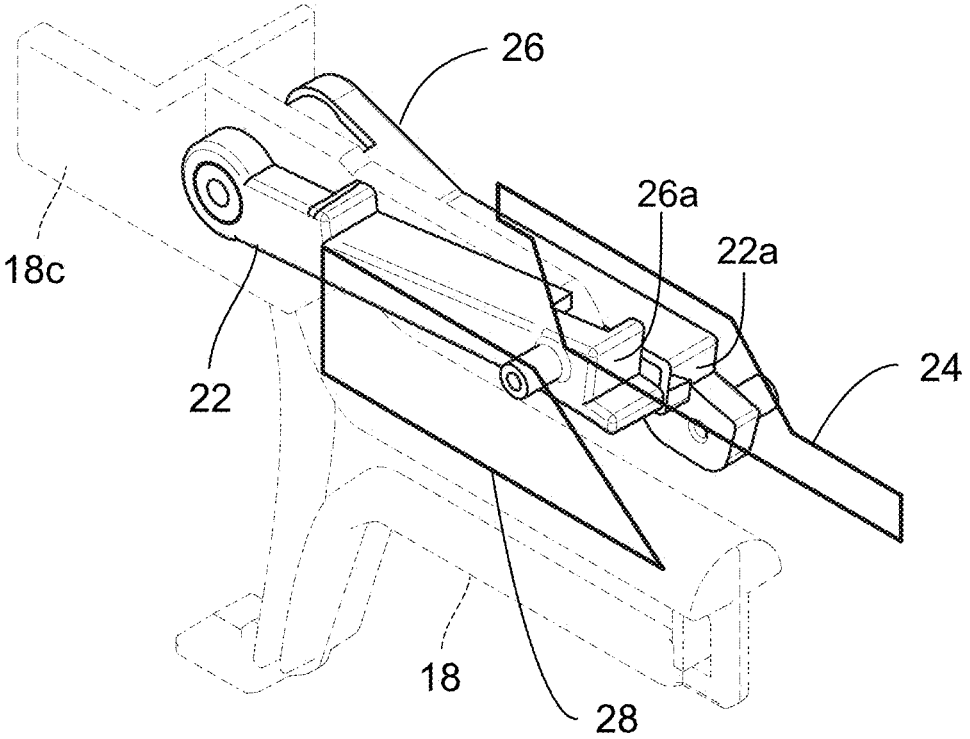
Figure 5G:
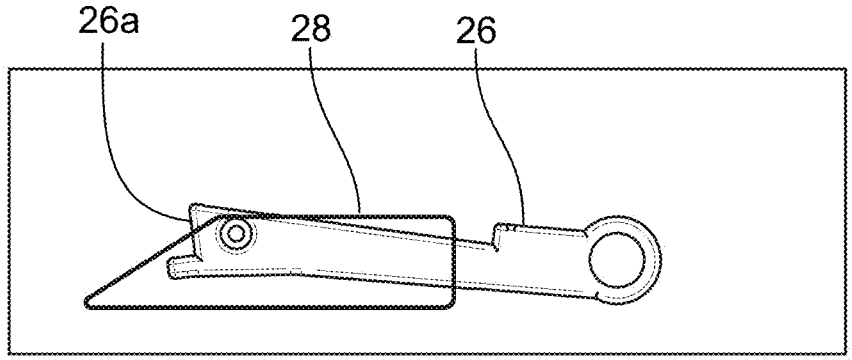
Figure 5F:
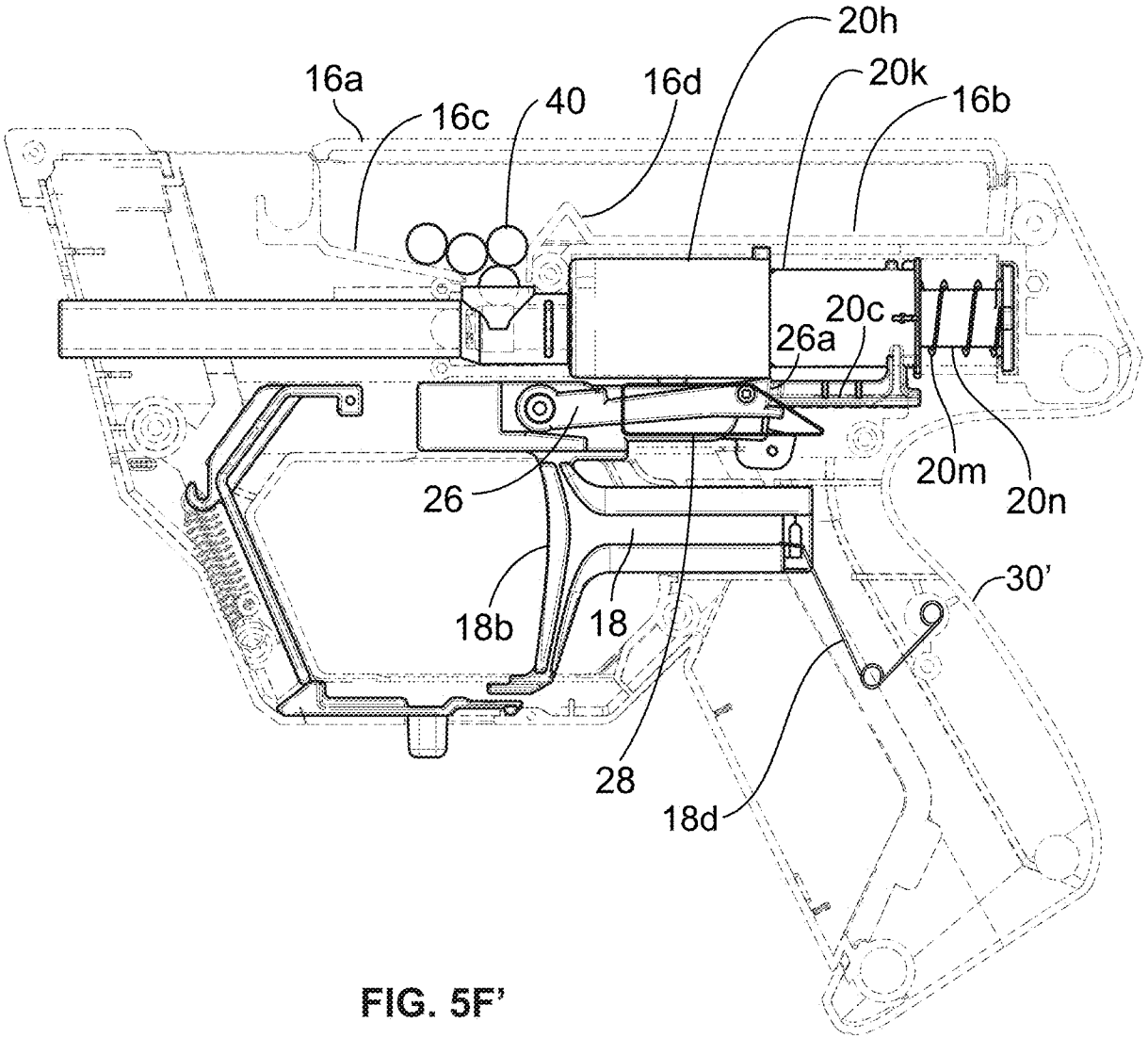

FIGS. 5A and 5F show the blaster 10 in side-elevation sectional views 30, 30' illustrating firing mechanism 20 where further trigger 18 movement allows the cam follower linkages 22, 26 to release and extend breech bolt 20*a*, and further retract piston 20*k* at third step. Herein the respective cylinder 20*h* and piston 20*k* tracking cam pathway tracks 24, 28 are used for raising and lowering operations of cam follower linkages 22, 26 pivotably provided in enlarged and inset views (see, FIGS. 5A', 5B, 5B', 5F', 5G, 5G'). FIGS. 5C, 5D, and 5E show third step firing mechanism 20 partial isometric views positioning the cam follower linkages 22, 26 at couplings 22*a*, 26*a* driving arms 20*i*, 20*r* coupling to cylinder 20*h* and piston 20*k* corresponding structures through the cam pathway tracks 24, 28.

Trigger 18*b* is pulled back even more which causes the cam follower linkages to also retract further. FIG. 5G shows the tracking between the piston cam follower linkage 26 and piston cam pathway track 28. The tracking end 26*b* is still high and therefore the piston follower coupling 26*a* is still engaged with the piston driving coupling 20*i*. FIG. 5B shows the tracking between the cylinder cam follower linkage 26 and the cylinder cam pathway track 22. The tracking end 22*b* is now low and therefore the cylinder follower coupling 22*a* becomes unengaged with the cylinder driving coupling 20*r*. The retraction of the cam follower linkages causes the piston follower coupling 26*a* to apply a force on the piston driving coupling 20*i* which in turn causes the piston 20*k* to retract further as well. However, the cylinder follower coupling 22*a* disengages with the cylinder driving coupling 20*r*. Therefore, the biasing force applied on the air compression element 20*s* by the breech bolt spring 200 causes the air compression element 20*s* to advance. The breech bolt 20*a* extends into the pre-firing area 20*e*. This extension causes the gel round to become locked in the pre-firing area 20*e* between the breech bolt seal 20*b* and the barrel seal 20*t*. Additionally, this the breech bolt 20*b* prevents any further gel rounds from entering the pre-firing area 20*e* through the breech 20*d*.

Figure 6F:
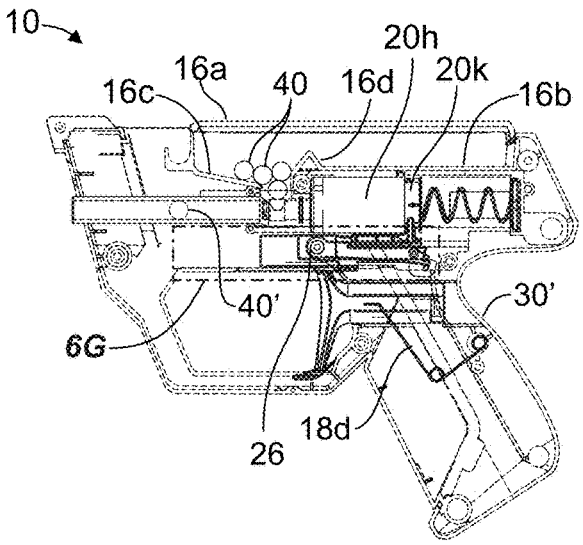
FIGS. 6A, 6A', 6B, 6B' and 6F, 6F', 6G, 6G' show the blaster embodiment in side-elevation firing mechanism sectional and respective cylinder and piston cam pathway tracking/cam follower linkages inset views, along with FIGS. 6C, 6D, and 6E advancing to a firing step for firing mechanism partial isometric views illustrating the cam pathway tracks/cam follower linkages functionally attached at the conveyor of the blaster trigger.
Figure 6A:
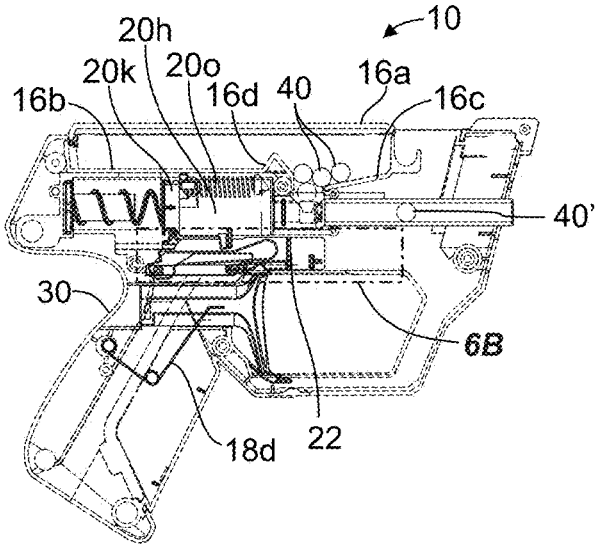
Figure 6G:
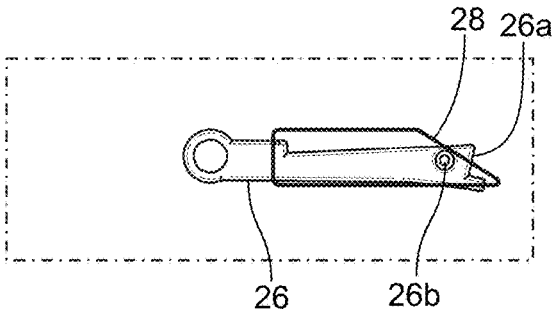
Figure 6B:
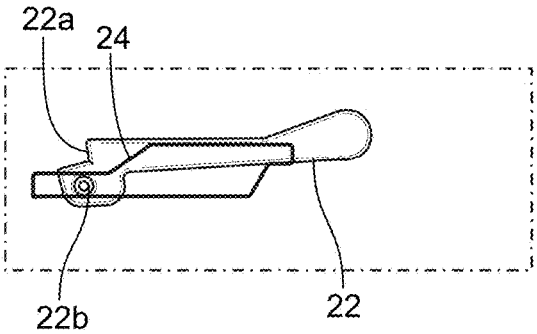
Figure 6A:
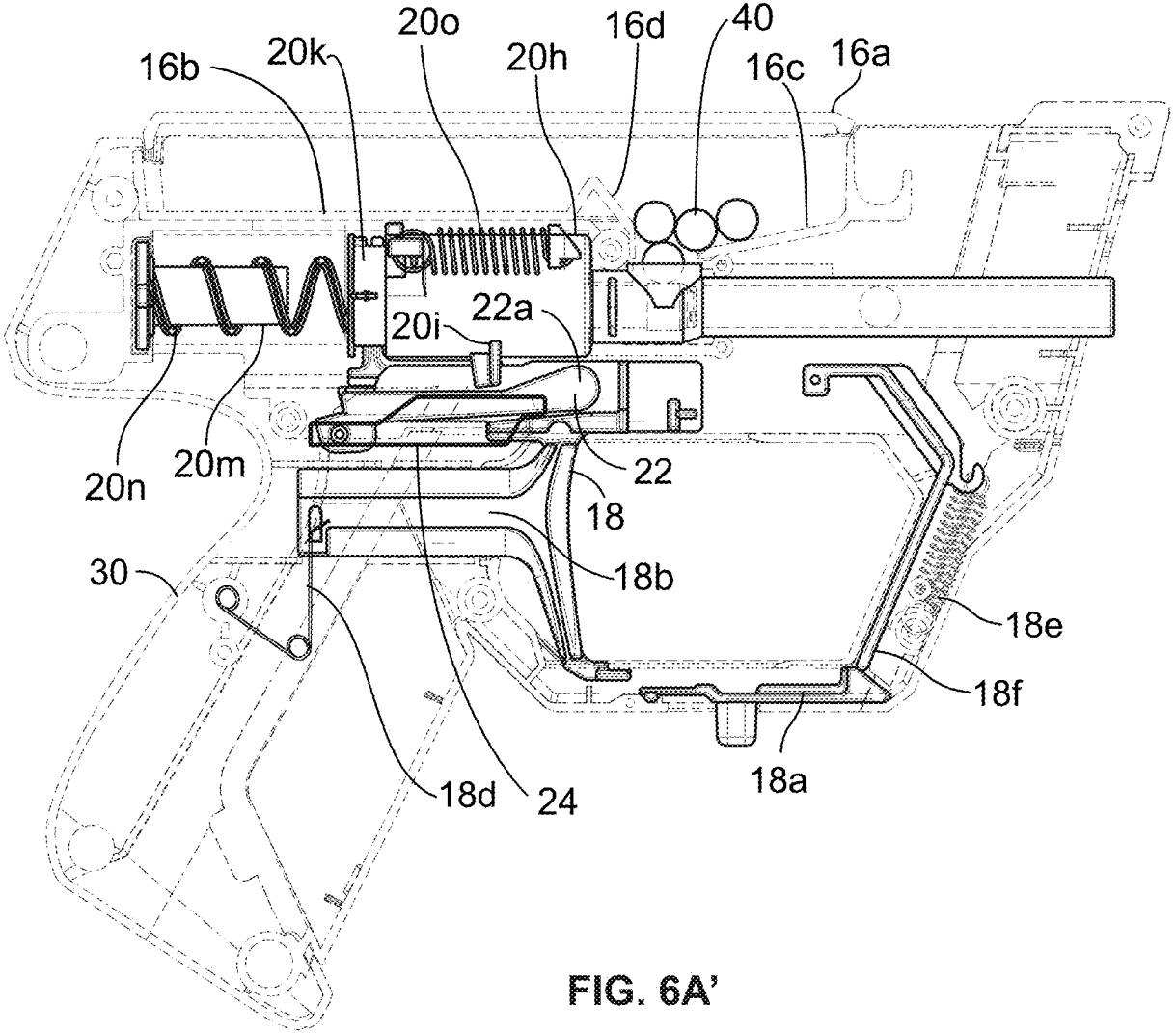
Figure 6C:
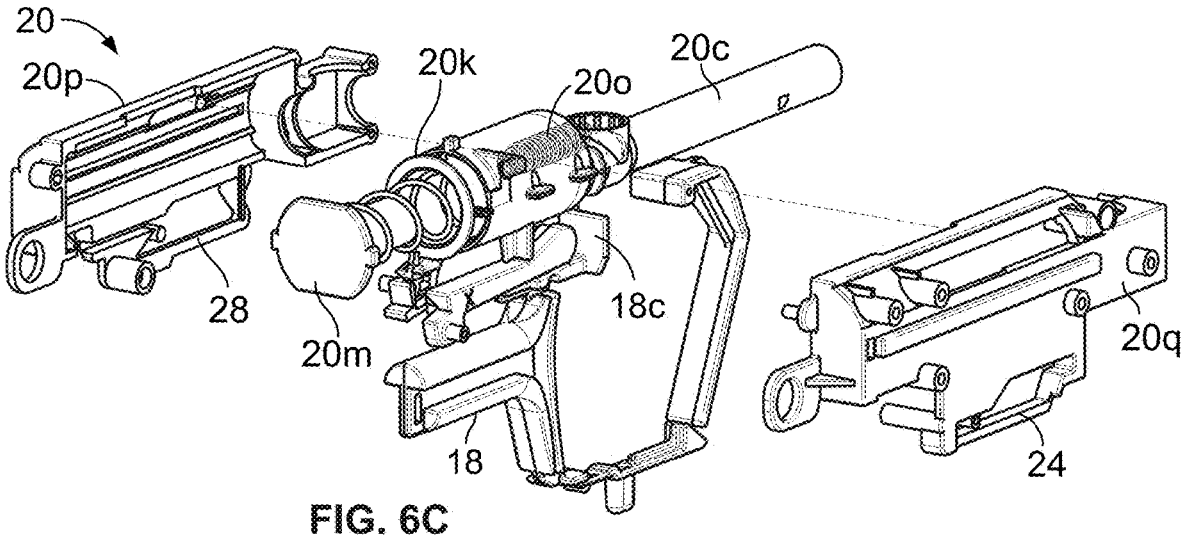
Figure 6B:
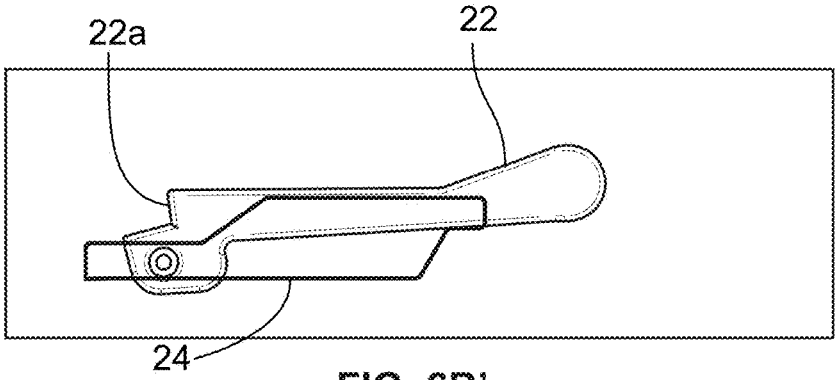
Figure 6D:
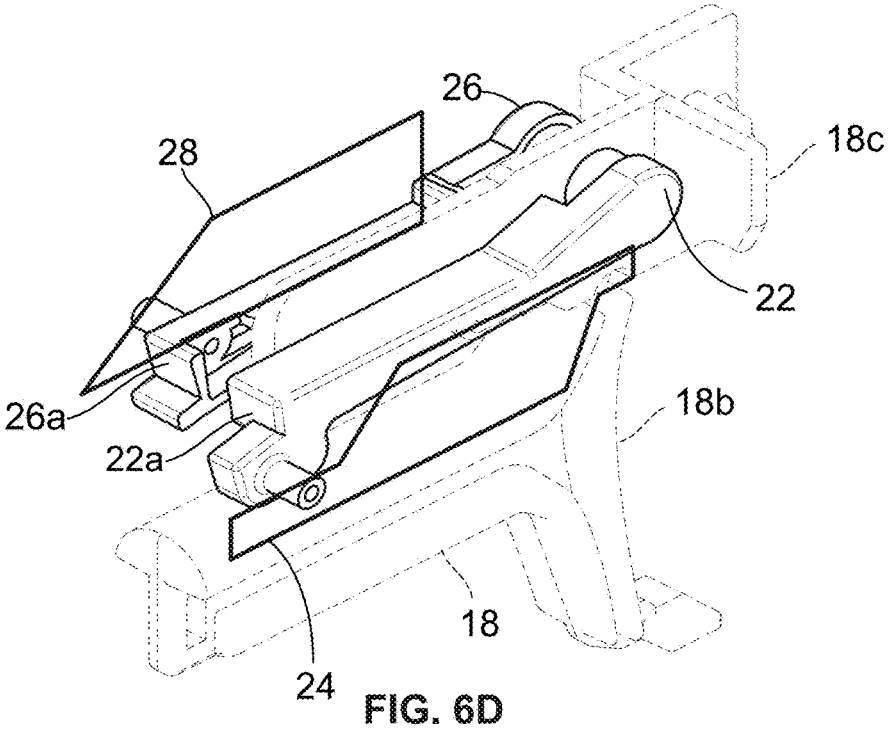
Figure 6E:
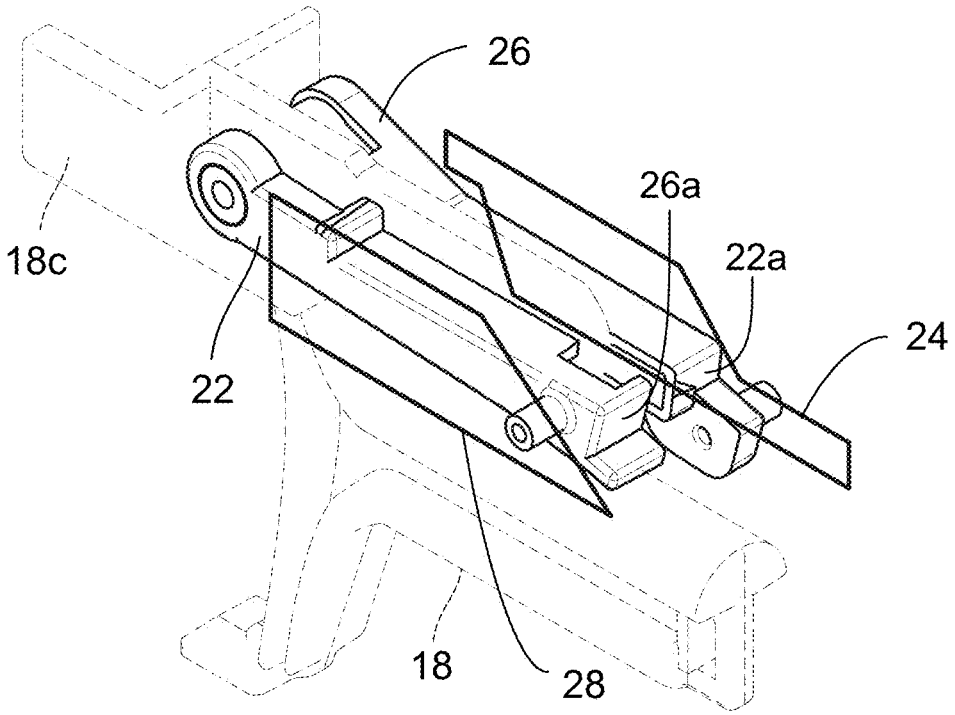
Figure 6G:
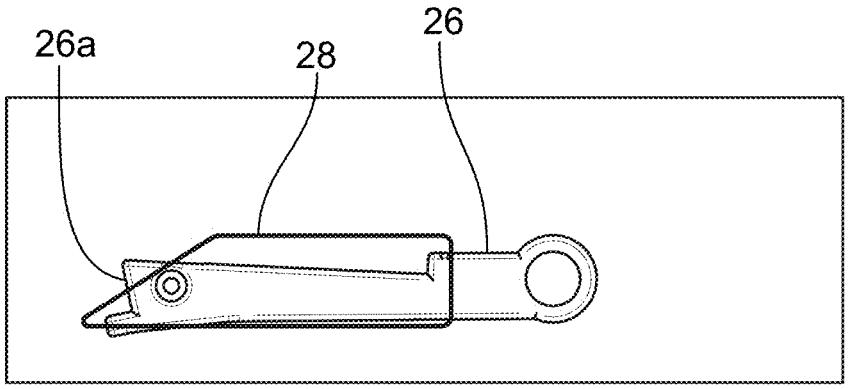
Figure 6F:
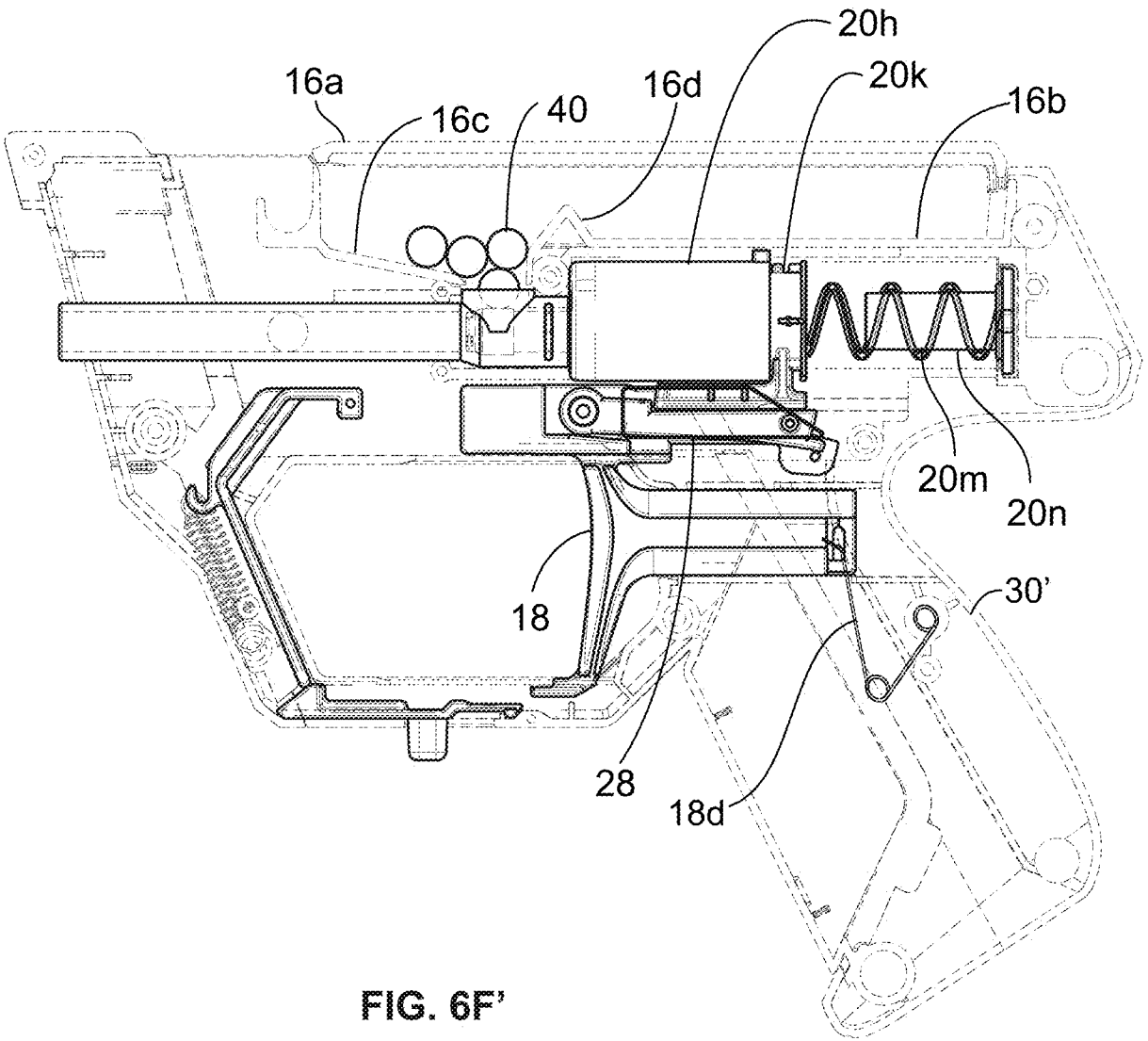

FIGS. 6A and 6F show the blaster 10 in side-elevation sectional views 30, 30' illustrating firing mechanism 20 where further trigger 18 advancement releases the cam follower linkages 22, 26 to release piston 20*k* at fourth step to fire projectile round 40'. Herein the respective cylinder 20*h* and piston 20*k* tracking cam pathway tracks 24, 28 are used for raising and lowering operations of cam follower linkages 22, 26 pivotably provided in enlarged and inset views (see, FIGS. 6A', 6B, 6B', 6F', 6G, 6G'). FIGS. 6C, 6D, and 6E show fourth step firing mechanism 20 partial isometric views positioning the cam follower linkages 22, 26 at couplings 22*a*, 26*a* driving arms 20*i*, 20*r* coupling to cylinder 20*h* and piston 20*k* corresponding structures through the cam pathway tracks 24, 28. Trigger 18*b* is pulled back even more which causes the cam follower linkages to also retract further. FIG. 6G shows the tracking between the piston cam follower linkage 26 and piston cam pathway track 28. The tracking end 26*b* is now low and therefore the piston follower coupling 26*a* becomes unengaged with the piston driving coupling 20*i*. FIG. 6B shows the tracking between the cylinder cam follower linkage 26 and the cylinder cam pathway track 22. The tracking end 22*b* is still low and therefore the cylinder follower coupling 22*a* is still unengaged with the cylinder driving coupling 20*r*.

The cylinder follower coupling 26*a* is already disengaged with the piston driving coupling 20*i* so the air compression element 20*s* remains in the advanced position. Therefore, the breech bolt 20*a* continues to seal the breech 20*d*. However, the piston follower coupling 26*a* disengages with piston driving coupling 20*r*. Therefore, the biasing force applied on piston 20*k* by the piston spring 20*n* causes the piston 20*k* to advance. The advance of the piston 20*k* is sudden causing the air within the air compression element 20*s* to compress. The compressed air exits the air compression element 20*s* through the breech bolt channel 20*w* which launches a gel round through the barrel seal 20*t* and barrel 20*c*.

Figure 7F:
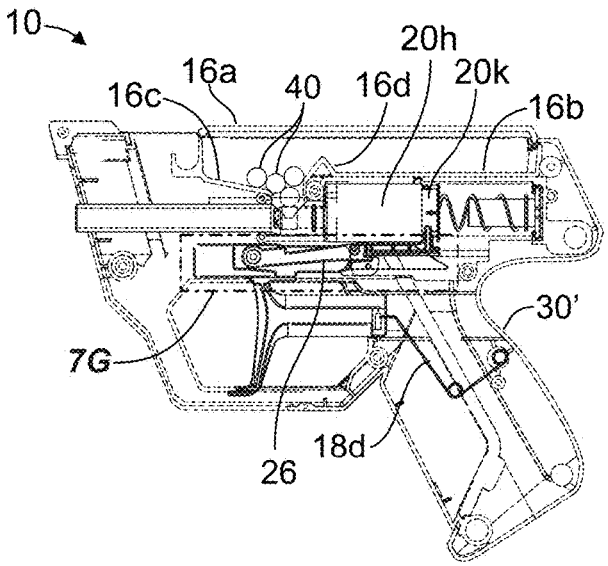
FIGS. 7A, 7A', 7B, 7B' and 7F, 7F', 7G, 7G' show the blaster embodiment in side-elevation firing mechanism sectional and respective cylinder and piston cam pathway tracking/cam follower linkages inset views, along with FIGS. 7C, 7D, and 7E for a reinitialization step of the firing mechanism partial isometric views illustrating the cam pathway tracks/cam follower linkages functionally attached at the conveyor of the blaster trigger.
Figure 7A:
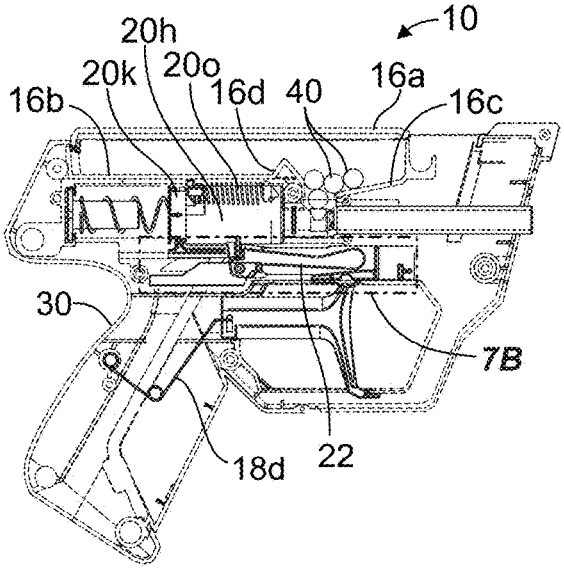
Figure 7G:
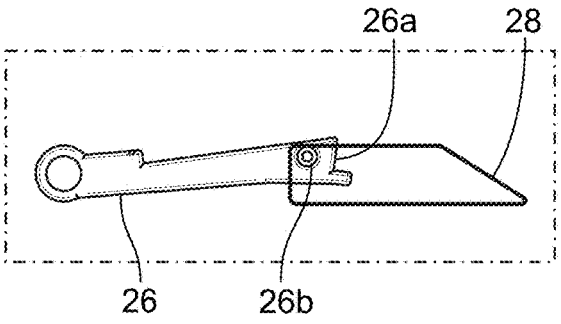
Figure 7B:
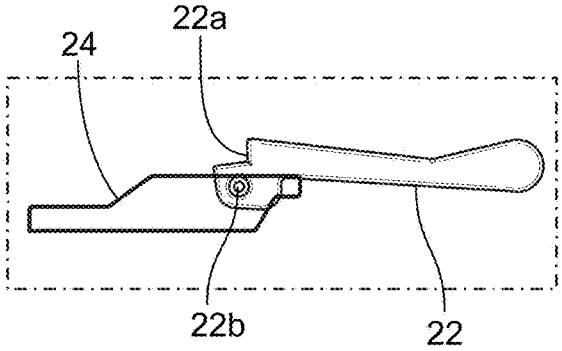
Figure 7A:
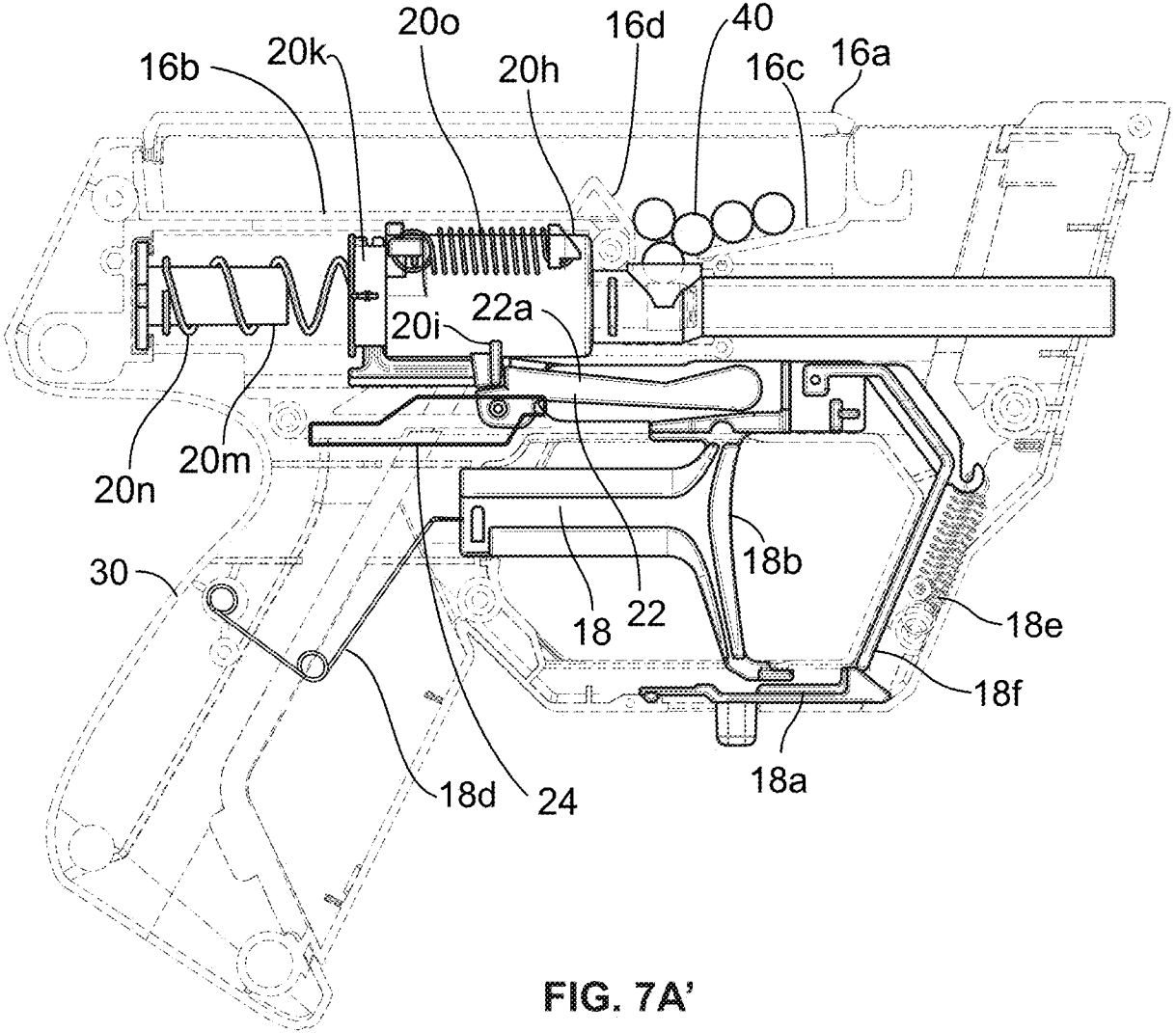
Figure 7C:
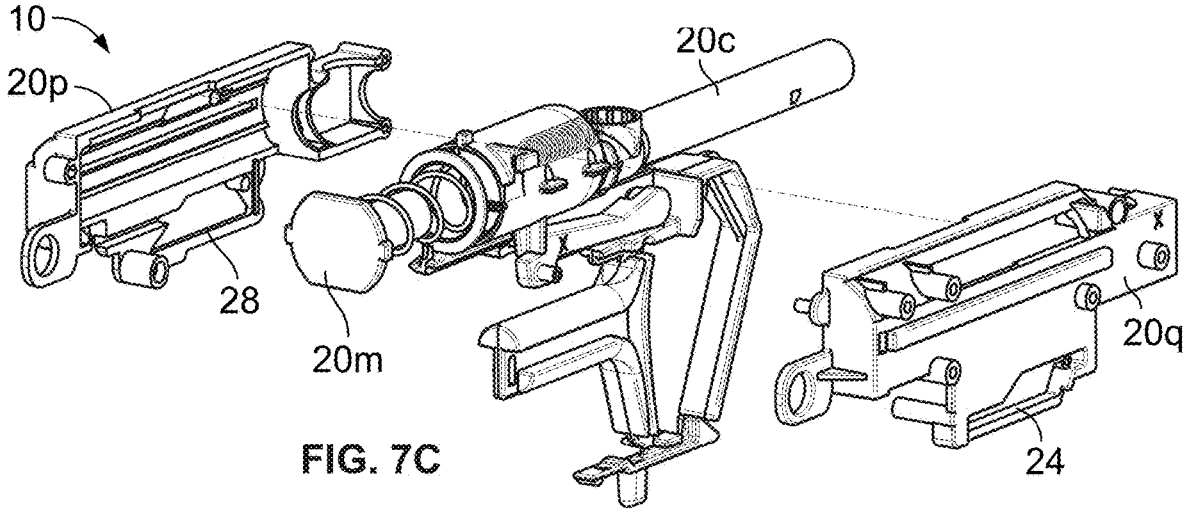
Figure 7B:
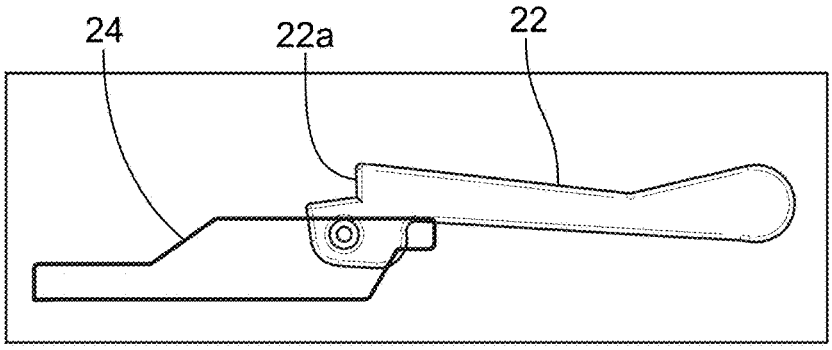
Figure 7D:
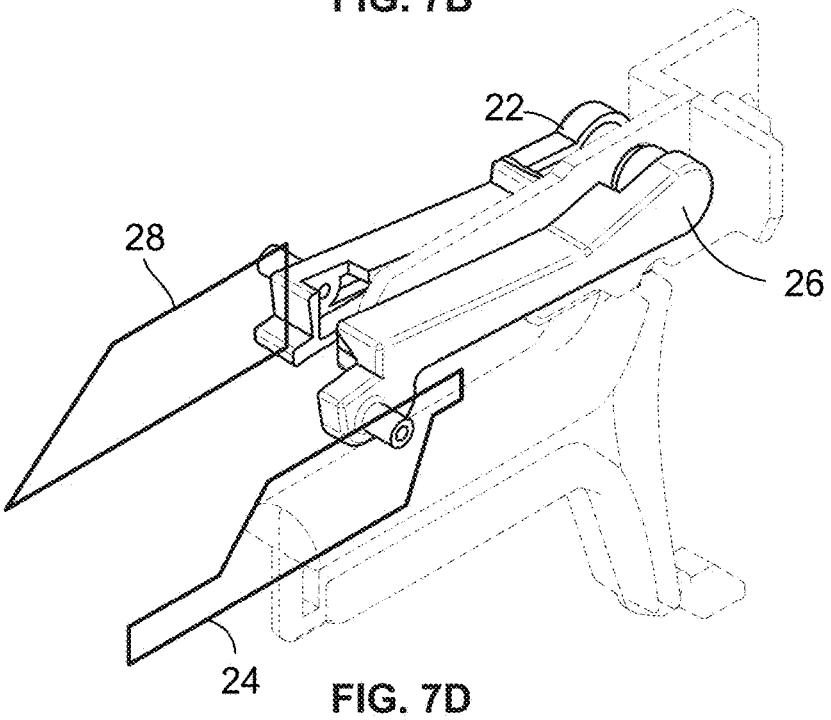
Figure 7E:
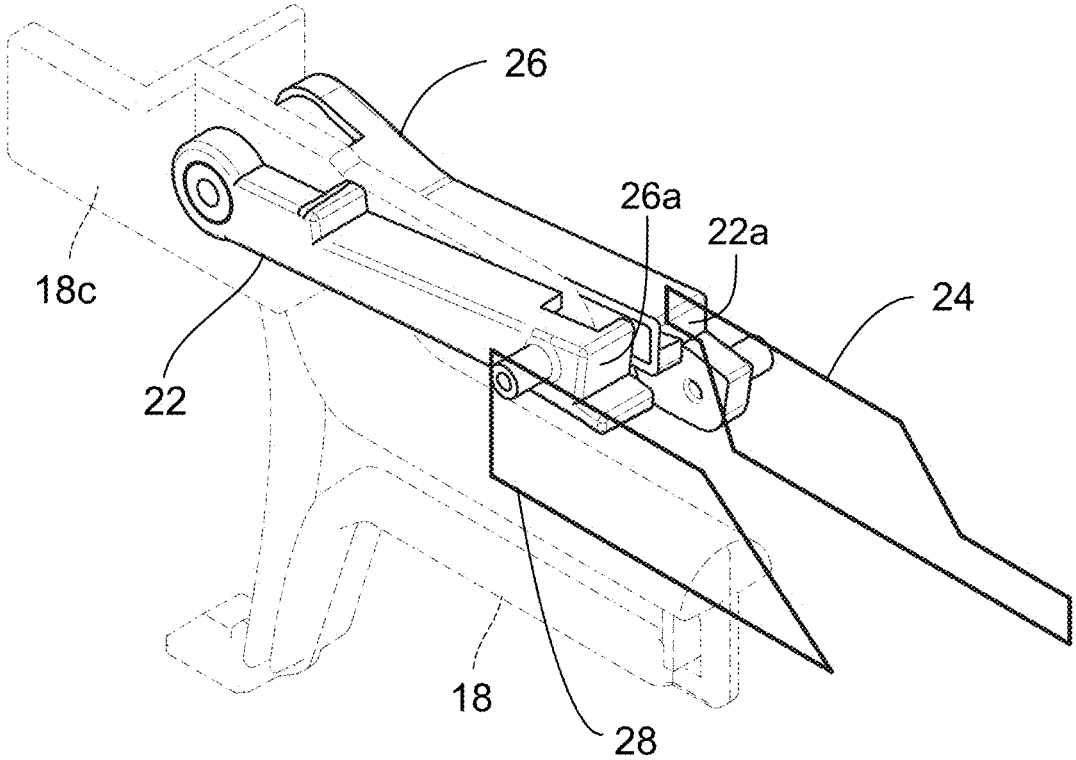
Figure 7G:
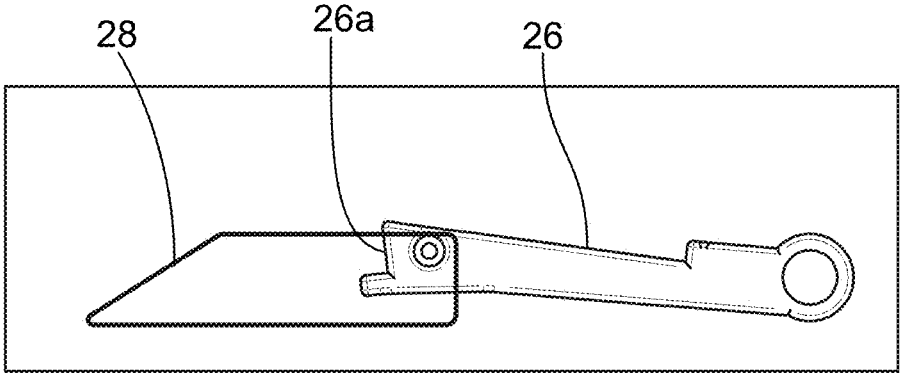
Figure 7F:
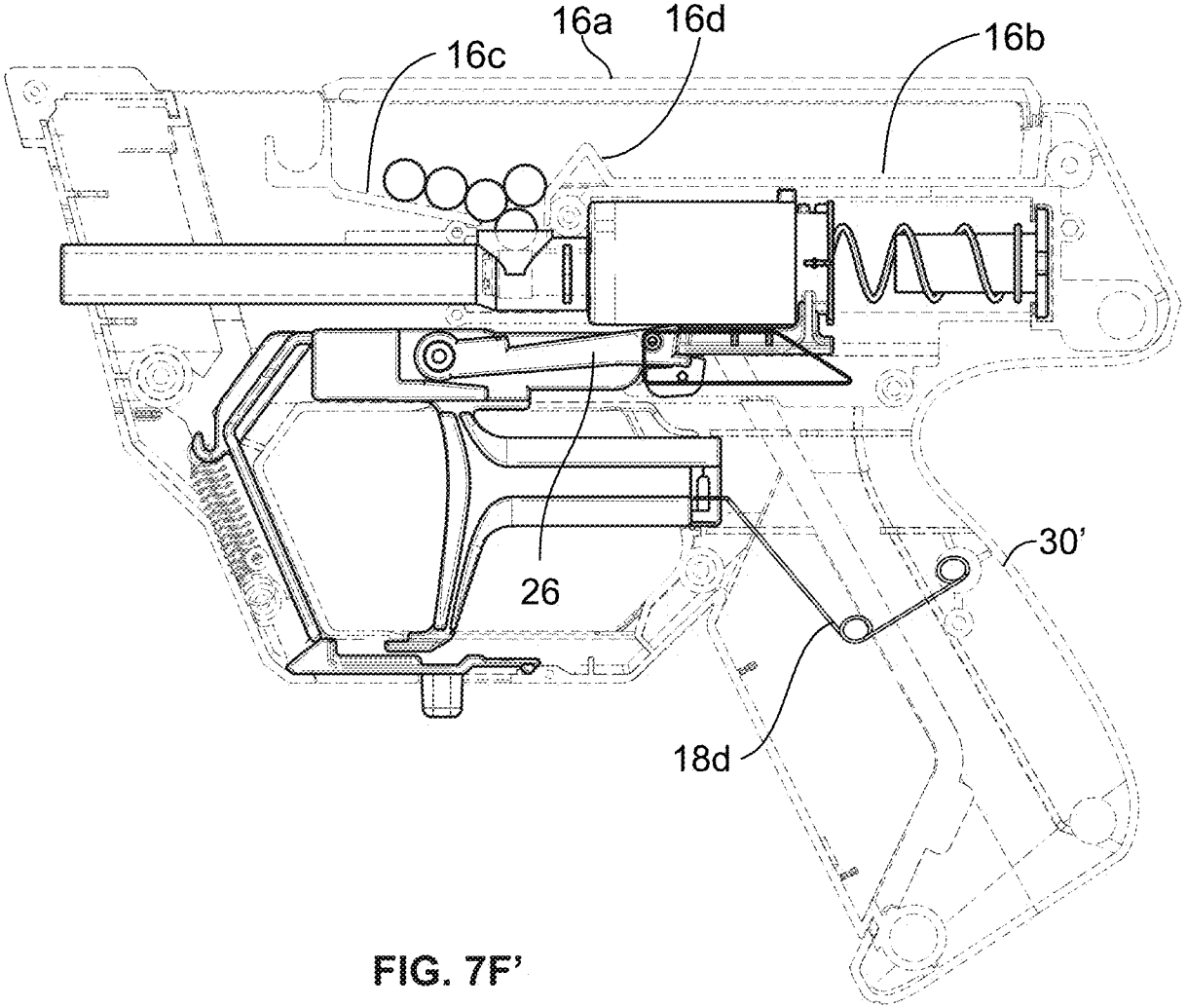

FIGS. 7A and 7F show the blaster 10 in side-elevation sectional views 30, 30' illustrating firing mechanism 20 where returning of trigger 18 with uncoupled cam follower linkages 22, 26 resets firing mechanism 20 to reinitialize at fifth step. Herein the respective cylinder 20*h* and piston 20*k* tracking cam pathway tracks 24, 28 are used for raising and lowering operations of cam follower linkages 22, 26 pivotably provided in enlarged and inset views (see, FIGS. 7A', 7B, 7B', 7F', 7G, 7G'). FIGS. 7C, 7D, and 7E show fifth step firing mechanism 20 partial isometric views positioning the cam follower linkages 22, 26 at couplings 22*a*, 26*a* driving arms 20*i*, 20*r* coupling to cylinder 20*h* and piston 20*k* corresponding structures through the cam pathway tracks 24, 28. Trigger 18*b* is now fully advanced. FIG. 7G shows the tracking between the piston cam follower linkage 26 and piston cam pathway track 28. FIG. 7B shows the tracking between the cylinder cam follower 26 and the cylinder cam pathway 22. Both tracking ends are in the high positions and therefore may engage with their respective driving couplings. As such, both cam follower linkages are fully advanced. Both follower couplings become engaged with their respective driving couplings. Additionally, the air compression element 20*s* and the piston 20*k* are fully advanced as the cam follower linkages also advanced. If at any step the trigger is returned to being fully advanced, the tracking ends will be high and the follower couplings will be in front of the driving couplings. The figures ending in C, D, E A' and F' are reprisals of the figures ending in A, F, G and B. Figures ending in C show an exploded view of the firing mechanism during each step. The figures ending in D and E show the cam follower linkages, cam pathway tracks, trigger 18*b* and conveyor 18*c* in an isometric view. The figures ending in A' and F' present enlarged details of the figures ending in A and F respectively. The figures ending in B' and G' are close copies of the figures ending in B and G respectively.

Figure 8A:
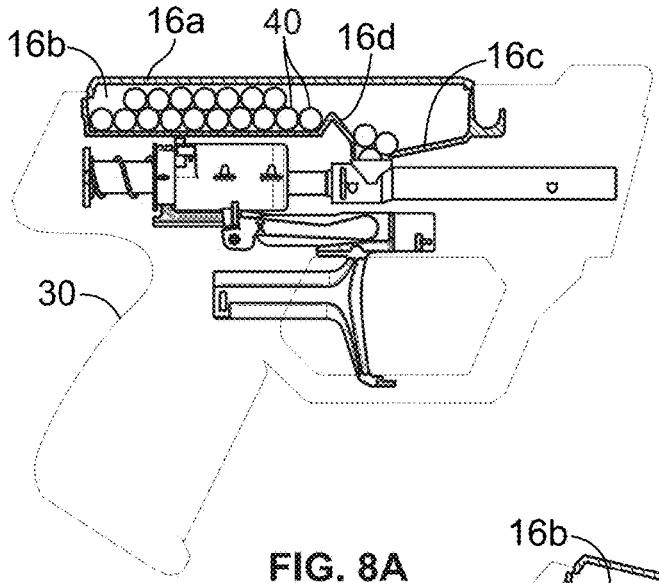
FIGS. 8A, 8B and 8C show the use of the magazine back tray and magazine front hopper with two separate areas facilitating reloading by tilting the blaster, such that rounds from the magazine front hopper will enter the breech of the blaster firing mechanism.
Figure 8B:
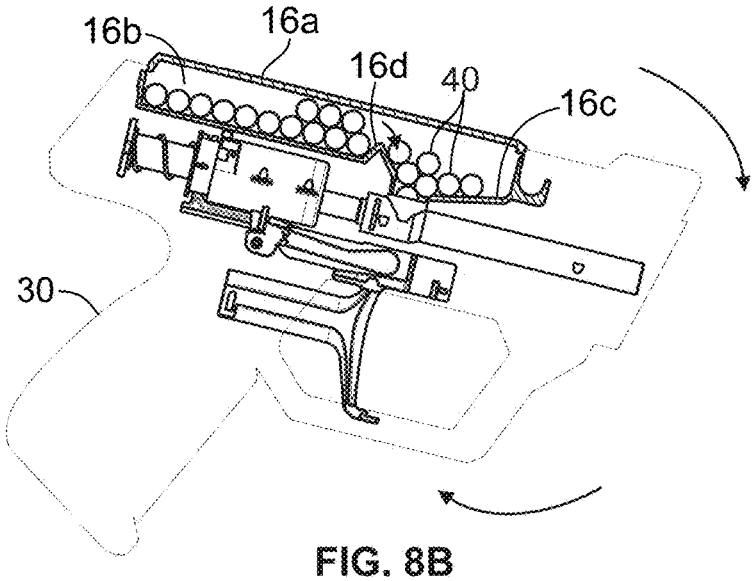
Figure 8C:
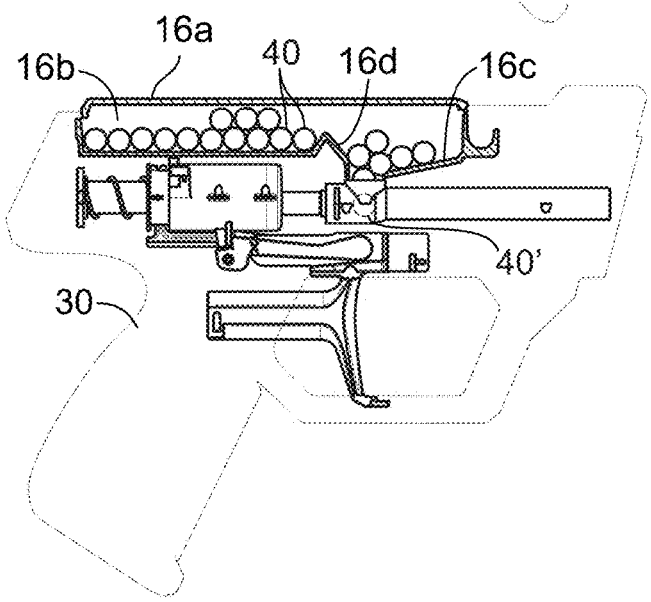

FIGS. 8A, 8B and 8C show the use of the hopper 16 with two separate areas facilitating reloading by tilting the blaster 10, such that rounds 40 from the magazine front hopper will enter the breech of the blaster firing mechanism 20, through the use of the magazine back tray 16*b* and magazine front hopper 16*c*. The two separate areas allow for a sort of reloading which is caused by tilting the blaster 10. Gel rounds 40 may reside in both the magazine back tray 16*b* and magazine front hopper 16*c*. However, only gel rounds 40 from the magazine front hopper 16*c* will enter the breech 20*d*. If the blaster 10 is fired enough, the front magazine tray 16*c* will eventually run out of gel rounds 40. FIG. 8A shows that there are few gel rounds 40 in the front magazine hopper 16*c*. If the blaster 10 is relatively level, gel rounds 40 in the magazine back tray 16*b* cannot make it over the magazine separator 16*d*.

FIG. 8B shows blaster 10 being tilted. Tilting the blaster 10 forward will allow gel rounds 40 to go over the magazine separator 16*d* from the magazine back tray 16*b* into the magazine front hopper 16*c*. FIG. 8C shows blaster 10 being returned to a relatively flat tilt, with FIG. 8C shown to have many gel rounds 40 in the front magazine hopper 16*c*.

While particular embodiments of the inventions have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launching apparatus, comprising:

a firing mechanism housing;

a projectile launching barrel;

an air compression element comprising a cylinder and an elongated breech bolt, the breech bolt having a proximal end at the cylinder and a breech bolt channel extending therethrough for fluid communication from the cylinder through the breech bolt for expelling compressed air from a distal end of the breech bolt, the cylinder having a cylinder driving coupling;

a piston slidably received at the cylinder of the air compression element, the piston having a piston driving coupling;

a cylinder cam pathway track at the firing mechanism housing;

a piston cam pathway track at the firing mechanism housing;

a trigger assembly including a conveyor;

a piston cam follower linkage having a tracking end at the piston cam pathway track, a piston trigger end pivoted at the conveyor, and a piston follower coupling for engaging the piston driving coupling;

a cylinder cam follower linkage having a tracking end at the cylinder cam pathway track, a cylinder trigger end pivoted at the conveyor, and a cylinder follower coupling for engaging the cylinder driving coupling; and a pre-firing area defining a breech and an alignment passage at the firing mechanism housing including at least one barrel seal aligned with the projectile launching barrel, the breech being capable of receiving one or more projectiles with the breech bolt of the air compression element capable of extending into the pre-firing area to position a received projectile between the distal end of the breech bolt and the barrel seal.

2. The toy launching apparatus of claim 1, comprising a hopper at the breech for receiving one or more projectiles by gravity into the pre-firing area.

3. The toy launching apparatus of claim 1, comprising a magazine clip at the breech for feeding one or more projectiles received into the pre-firing area.

4. The toy launching apparatus of claim 1, wherein the cylinder driving coupling comprises a cylinder driving arm attached to the cylinder of the air compression element, and the piston driving coupling comprises a piston driving arm attached to the piston.

5. The toy launching apparatus of claim 4, wherein the cylinder follower coupling comprises a cylinder follower projecting step for being brought into contact with the cylinder driving arm, and the piston follower coupling comprises a piston follower projecting step for being brought into contact with the piston driving arm.

6. The toy launching apparatus of claim 1, comprising a breech spring and a piston spring, the piston spring being compressed by the piston follower coupling contacting the piston driving coupling actuated by the conveyor of the trigger assembly upon pulling of the trigger engaging the piston cam follower linkage, the cylinder follower coupling contacting the cylinder driving coupling actuated by the conveyor engaging the cylinder cam follower linkage for withdrawing the breech bolt of the air compression element from the breech of the pre-firing area, the breech spring being connected to and extending with the air compression element.

7. The toy launching apparatus of claim 6, comprising a trigger spring, the breech spring connected to the air compression element upon further pulling of the trigger moving the conveyor to disengage the cylinder cam follower linkage releasing the breech spring for extending the breech bolt of the air compression element into the pre-firing area, with the trigger spring returning the conveyor of the trigger assembly upon release of the trigger.

8. The toy launching apparatus of claim 7, wherein further pulling of the trigger moves the conveyor to disengage the piston cam follower linkage releasing the piston spring for advancing the piston in the cylinder of the air compression element into the pre-firing area, with the trigger spring returning the conveyor of the trigger assembly upon release of the trigger for advancing the piston, causing compressed air to expel through the breech bolt channel extending through the breech bolt for expelling compressed air from the distal end of the breech bolt, and outwardly launch the one or more projectiles through the barrel seal and the projectile launching barrel.

9. A toy launching apparatus, comprising:

a firing mechanism housing;

a projectile launching barrel;

an air compression element comprising a cylinder and an elongated breech bolt, the breech bolt having a proximal end at the cylinder and a breech bolt channel extending therethrough for fluid communication from the cylinder through the breech bolt for expelling compressed air from a distal end of the breech bolt;

a cylinder driving arm connected to the cylinder of the air compression element;

a breech spring connected between the air compression element and the firing mechanism housing;

a piston slidably received at the cylinder of the air compression element;

a piston driving arm attached to the piston;

a cylinder cam pathway track at the firing mechanism housing;

a piston cam pathway track at the firing mechanism housing;

a trigger assembly including a conveyor;

a piston cam follower linkage having a tracking end at the piston cam pathway track, a piston trigger end pivoted at the conveyor, and a piston follower projecting step for being brought into contact with the piston driving arm;

a cylinder cam follower linkage having a tracking end at the cylinder cam pathway track, a cylinder trigger end pivoted at the conveyor, and a cylinder follower projecting step for being brought into contact with the cylinder driving arm, the breech spring biased to extend with cylinder cam follower linkage movement imparted to the cylinder and the elongated breech bolt of the air compression element; and a pre-firing area defining a breech and an alignment passage at the firing mechanism housing including at least one barrel seal aligned with the projectile launching barrel, the breech being capable of receiving one or more projectiles with the breech bolt of the air compression element capable of extending into the pre-firing area to position a received projectile between the distal end of the breech bolt and the barrel seal.

10. The toy launching apparatus of claim 9, comprising a hopper at the breech for receiving one or more projectiles by gravity into the pre-firing area.

11. The toy launching apparatus of claim 9, comprising a magazine clip at the breech for feeding one or more projectiles received into the pre-firing area.

12. The toy launching apparatus of claim 9, comprising a piston spring at the piston biased for compression by the piston follower projecting step contacting the piston driving arm actuated by the conveyor of the trigger assembly upon pulling of the trigger engaging the piston cam follower linkage.

13. The toy launching apparatus of claim 12, wherein the cylinder follower projecting step contacting the cylinder driving arm actuated by the conveyor engaging the cylinder cam follower linkage for withdrawing the breech bolt of the air compression element from the breech of the pre-firing area.

14. The toy launching apparatus of claim 13, further comprising a trigger spring where pulling of the trigger moving the conveyor to disengage the cylinder cam follower linkage releases the breech spring for extending the breech bolt of the air compression element into the pre-firing area, with the trigger spring returning the conveyor of the trigger assembly upon release of the trigger.

15. The toy launching apparatus of claim 14, wherein further pulling of the trigger moves the conveyor to disengage the piston cam follower linkage releasing the piston spring for advancing the piston in the cylinder of the air compression element into the pre-firing area.

16. The toy launching apparatus of claim 15, wherein the trigger spring returns the conveyor of the trigger assembly upon release of the trigger for advancing the piston, causing compressed air to expel through the breech bolt channel extending through the breech bolt for expelling compressed air from the distal end of the breech bolt, and outwardly launch the one or more projectiles through the barrel seal and the projectile launching barrel.

17. The toy launching apparatus of claim 9, comprising a trigger lock for engaging the conveyor of the trigger assembly to inhibit and lock out pulling of the trigger.

18. A toy launching method, comprising the steps of:

providing a receptacle for receiving multiple projectile rounds for launching with a firing mechanism housing through a projectile launching barrel;

an air compression step using a cylinder and an elongated breech bolt having a channel extending therethrough for fluid communication from the cylinder through the breech bolt for expelling compressed air;

connecting a cylinder driving arm to the cylinder;

receiving a piston slidably in the cylinder;

attaching a piston driving arm to the piston;

defining a cylinder cam pathway track at the firing mechanism housing;

defining a piston cam pathway track at the firing mechanism housing;

integrating a trigger assembly with a conveyor;

positioning a piston cam follower linkage tracking end at the piston cam pathway track, a piston trigger end pivoted at the conveyor, and a piston follower projection for being brought into contact with the piston driving arm; and positioning a cylinder cam follower linkage tracking end at the cylinder cam pathway track, a cylinder trigger end pivoted at the conveyor, and a cylinder follower projection for being brought into contact with the cylinder driving arm.

19. The toy launching method of claim 18, further comprising:

defining a barrier and hopper area inside the receptacle, allowing for a user to agitate one or more received multiple projectile rounds beyond the barrier and into the hopper area with at least one of the received projectiles being aligned therein by gravity;

connecting a breech spring to the firing mechanism housing, the breech spring biased to extend with cylinder cam follower linkage movement imparted to the cylinder and the elongated breech bolt; and defining a pre-firing area and breech with an alignment passage at the firing mechanism housing including at least one barrel seal aligned with the projectile launching barrel, positioning the at least one of the received projectiles with the elongated breech bolt extending into the pre-firing area at the least one barrel seal.

20. The toy launching method of claim 19, wherein the receiving step comprises:

providing the receptacle as a magazine; and closing the cover to the magazine for sealing the one or more projectile rounds therein.

* * * * *